US009719245B1

(12) United States Patent
Rao Vemuri et al.

(10) Patent No.: US 9,719,245 B1
(45) Date of Patent: Aug. 1, 2017

(54) LATERAL REINFORCEMENT SYSTEM AND METHOD FOR CONCRETE STRUCTURES

(71) Applicants: Venkata Rangarao Rao Vemuri, Hyderabad (IN); V. L. Subramaniam Kolluru, Hyderabad (IN); Suriya Prakash Shanmugam, Yeddumailaram (IN)

(72) Inventors: Venkata Rangarao Rao Vemuri, Hyderabad (IN); V. L. Subramaniam Kolluru, Hyderabad (IN); Suriya Prakash Shanmugam, Yeddumailaram (IN)

(73) Assignee: INDIAN INSTITUTE TECHNOLOGY, Hyderabad (IN)

( * ) Notice: Subject to any disclaimer, the term of this patent is extended or adjusted under 35 U.S.C. 154(b) by 0 days.

(21) Appl. No.: 15/168,116

(22) Filed: May 30, 2016

(51) Int. Cl.
*E04B 1/41* (2006.01)
*E04C 5/16* (2006.01)

(52) U.S. Cl.
CPC ..... *E04B 1/4178* (2013.01); *E04B 1/4185* (2013.01); *E04C 5/167* (2013.01)

(58) Field of Classification Search
CPC ..... E04B 1/4178; E04B 1/4185; E04C 5/163; E04C 5/167
See application file for complete search history.

(56) References Cited

U.S. PATENT DOCUMENTS 6,141,937 A * 11/2000 Dressler ..... E04C 5/163 52/298
6,240,688 B1 * 6/2001 Dressler ..... E04C 5/163 52/295
6,655,105 B2 * 12/2003 Swenson ..... E04C 5/163 403/391
2011/0247291 A1 * 10/2011 Hammon ..... E04C 5/166 52/684
2013/0186030 A1 * 7/2013 Hebert, Jr. ..... E04F 21/00 52/698

* cited by examiner

*Primary Examiner* — Andrew J Triggs

(57) ABSTRACT

A lateral reinforcement system for a concrete structure having axially disposed structural bars. The lateral reinforcement system comprises a plurality of reinforcement ties disposed at an inclination to the axially disposed structural bars. A pair of reinforcement ties of the plurality of reinforcement ties is disposed at mirror inclinations to each other. In the pair of reinforcement ties, the reinforcement ties cross each other at diametrically opposite corners of the reinforcement ties at diametrically opposite axially disposed structural bars, such that, a first reinforcement tie of the pair of reinforcement ties crosses from inside of a second reinforcement tie of the pair of reinforcement ties at one structural bar, and the second reinforcement tie crosses from inside of the first reinforcement tie at the diametrically opposite structural bar. The plurality of reinforcement ties forms a three-dimensional interwoven network around the axially disposed structural bars.

9 Claims, 28 Drawing Sheets

LATERAL REINFORCEMENT SYSTEM AND METHOD FOR CONCRETE STRUCTURES

FIELD OF THE INVENTION

The present invention relates to lateral reinforcement systems and methods for concrete structures.

BACKGROUND OF THE INVENTION

Various systems for reinforcing building structural components for making reinforced concrete structures have been proposed. Generally, steel reinforcing unit is embedded in the cast concrete for providing the concrete structure to improve tensile strength, compressive strength and shear capacity. Specifically, such systems include one or more stirrups or ties with a series of bars placed along the axis of the member to form a cage like apparatus. Such stirrups and ties constitute one of the most critical factors of quality and seismic resistance of buildings. Some of such existing stirrups/tie for reinforcing the building structural components are described herein.

As per the prior arts described herein, FIG. 1 (PRIOR ART) describes a concrete structure 10 in which conventional ties 2 are installed on the vertical bars 4 and convention stirrups 6 are installed on the horizontal bars 8.

FIG. 2 (PRIOR ART) describes a conventional rectangular tie 20 (similar to conventional ties 2 or conventional stirrups bused in constructing a concrete structure (for example, the concrete structure 10). Tie 20 is usually made of solid steel bars of circular cross section with a diameter '$d_b$', length breadth 'B' and major diagonal dimension 'D'. Further, tie 20 comprises hooks 22 for anchoring the ties 20 to the load bearing element of the structure (for structures such as bars 8 of FIG. 1). Such conventional ties 20 when disposed around the plurality of the vertical bars/horizontal bars form a cage like structure.

FIG. 3 (PRIOR ART) illustrates such cage like structure 30 wherein a plurality of conventional rectangular ties 20 is disposed around the vertical bars 32. Specifically, the conventional rectangular ties 20 are placed one above the other parallel to the surface on which the vertical bars 32 are placed and perpendicular to the vertical bars 32. Two rectangular ties 20 have a height difference (spacing) of 'h' between them.

Similarly, FIG. 4 (PRIOR ART) describes a conventional circular tie 40 (similar to conventional ties 2 or conventional stirrups 6) used in constructing a concrete structure (for example, the concrete structure 10). Tie 40 is usually made of solid steel bars of circular cross section having a diameter '$d_b$', and cage diameter 'D'. Further, tie 40 comprises hooks 42 for anchoring the ties 40 to the load bearing element of the structure. Such conventional ties 40 when disposed around the plurality of the vertical bars/horizontal bars form a cage like structure.

FIG. 5 (PRIOR ART) illustrates such cage like structure 50 wherein a plurality of conventional circular ties 40 is disposed around the vertical bars 52. Specifically, the conventional circular ties 40 are placed one above the other parallel to the surface on which the vertical bars 52 are placed and perpendicular to the vertical bars 52. Two circular ties 40 have a height difference (spacing) of 'h' between them.

As illustrated in FIG. 1 (PRIOR ART), FIG. 3 (PRIOR ART) and FIG. 5 (PRIOR ART) the conventional configuration of the ties/stirrups only improves confinement of concrete at location of the ties/stirrups where it is disposed.

Specifically, confinement received by concrete is localized and dependent on the spacing of the ties/stirrups. Improvement in such concrete confinement is achieved on reducing the spacing of ties/stirrups which results in heavy congestion and consumption of reinforcement steel.

Further, when subjected to an earthquake, requirement of steel reinforcement in the form of ties/stirrups increases to meet the additional demand. Conventional configuration of the ties/stirrups as illustrated in FIG. 1 (PRIOR ART), FIG. 3 (PRIOR ART) and FIG. 5 (PRIOR ART) is localized and confined to its own plane. In this case, resistance to opening of cracks provided by steel reinforcement is limited to the plane where the tie/stirrups are confined. This leads to strength degradation for cycle after cycle of the earthquake ground motion (vibration) or under impact loads. Likewise, when structural elements are subject to impact loads (such as blast), conventional tie pattern systems are not efficient to resist such loads.

Accordingly, there exists a need for a lateral reinforcement system that provides enhanced performance of concrete structures compared to the conventional patterns. Also, there exists a need of a lateral reinforcement system which utilizes less amount of steel, having improved constructability, possessing an enhanced load carrying capacity, having an enhanced earthquake resistance and energy absorption and is cost effective.

SUMMARY OF THE INVENTION

In view of the foregoing disadvantages inherent in the prior-art, the general purpose of the present invention is to provide a lateral reinforcement system and method for concrete structures that is configured to include all advantages of the prior art and to overcome the drawbacks inherent in the prior art offering some added advantages.

In one aspect, the present invention provides a system for a lateral reinforcement system for a concrete structure having axially disposed structural bars. The lateral reinforcement system comprises a plurality of reinforcement ties disposed at an inclination to the axially disposed structural bars. A pair of reinforcement ties of the plurality of reinforcement ties is disposed at mirror inclinations to each other. In the pair of reinforcement ties, cross each other at diametrically opposite corners of the reinforcement ties at diametrically opposite axially disposed structural bars, such that, a first reinforcement tie of the pair of reinforcement ties crosses from inside of a second reinforcement tie of the pair of reinforcement ties at one structural bar, and the second reinforcement tie crosses from inside of the first reinforcement tie at the diametrically opposite structural bar. The plurality of reinforcement ties forms a three-dimensional interwoven network around the axially disposed structural bars.

In another aspect, the present invention provides a method for lateral reinforcement for concrete structures using the lateral reinforcement system of the present invention comprising the plurality of the reinforcement ties of the present invention.

BRIEF DESCRIPTION OF THE DRAWINGS

The advantages and features of the present invention will become better understood with reference to the following detailed description and claims taken in conjunction with the accompanying drawings, in which:

DETAILED DESCRIPTION OF THE INVENTION

Figure 1:
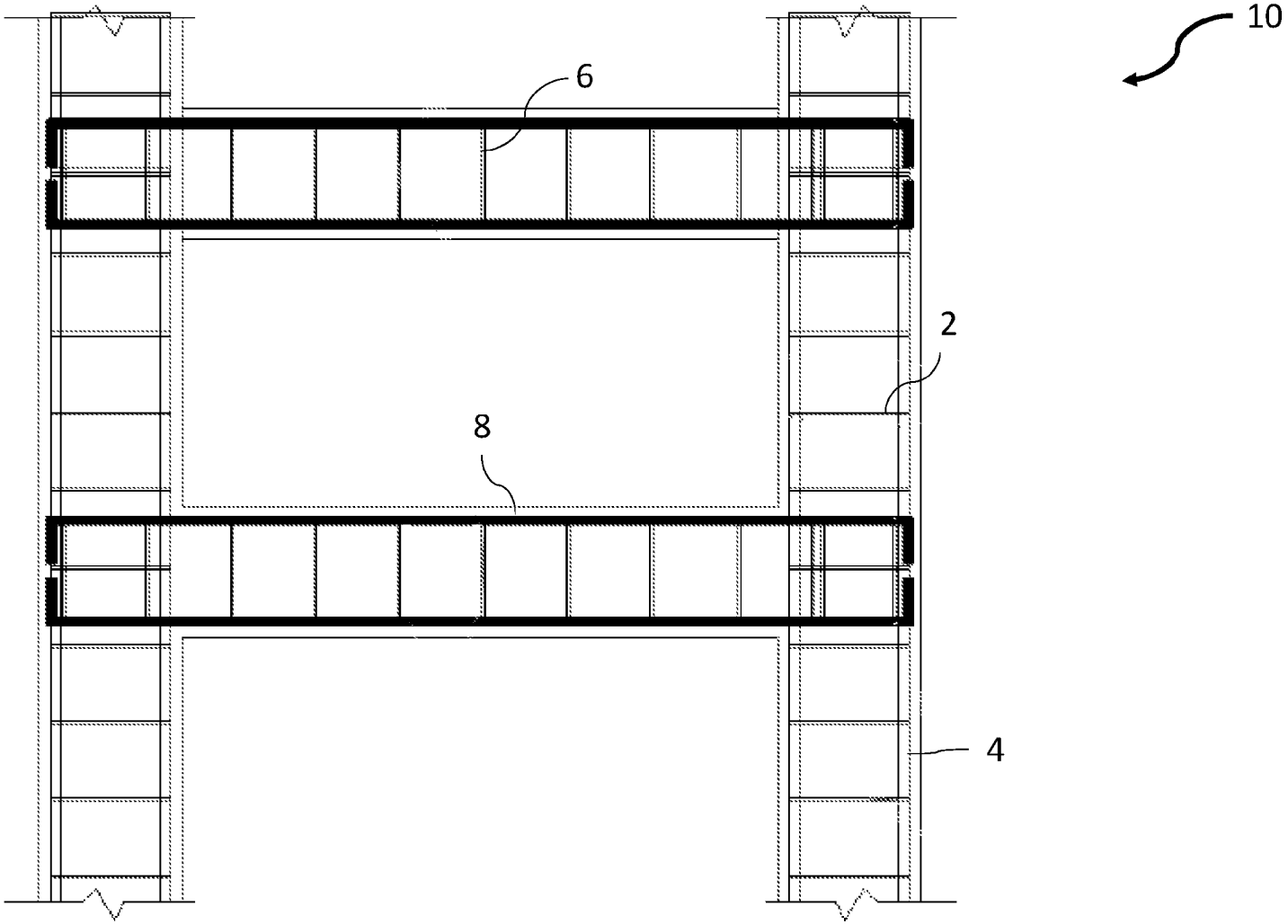
FIG.1 (PRIOR ART)
FIG. 1 (PRIOR ART) illustrates a concrete structure in which conventional ties are installed on the vertical bars and convention stirrups are installed on the horizontal bars.
Figure 2:
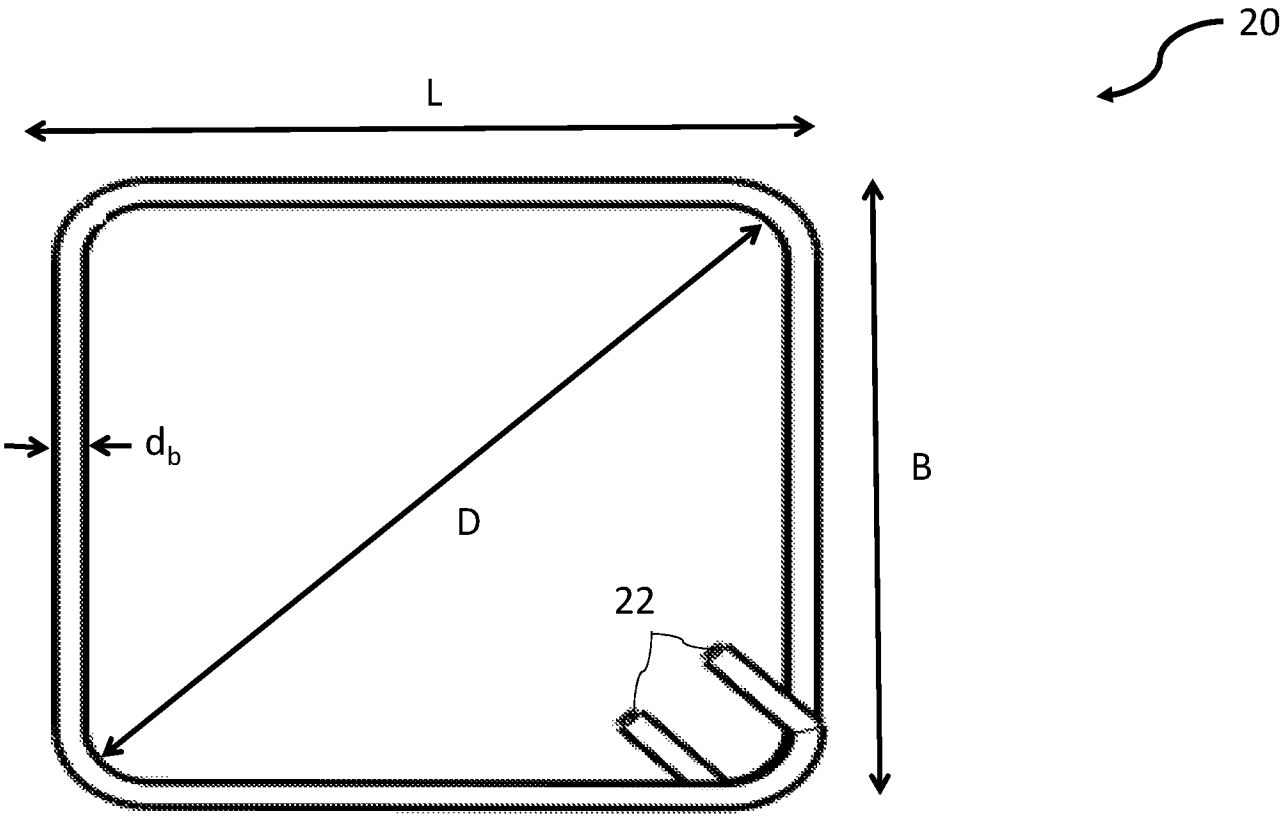
FIG.2 (PRIOR ART)
FIG. 2 (PRIOR ART) illustrates a conventional rectangular tie.
Figure 3:
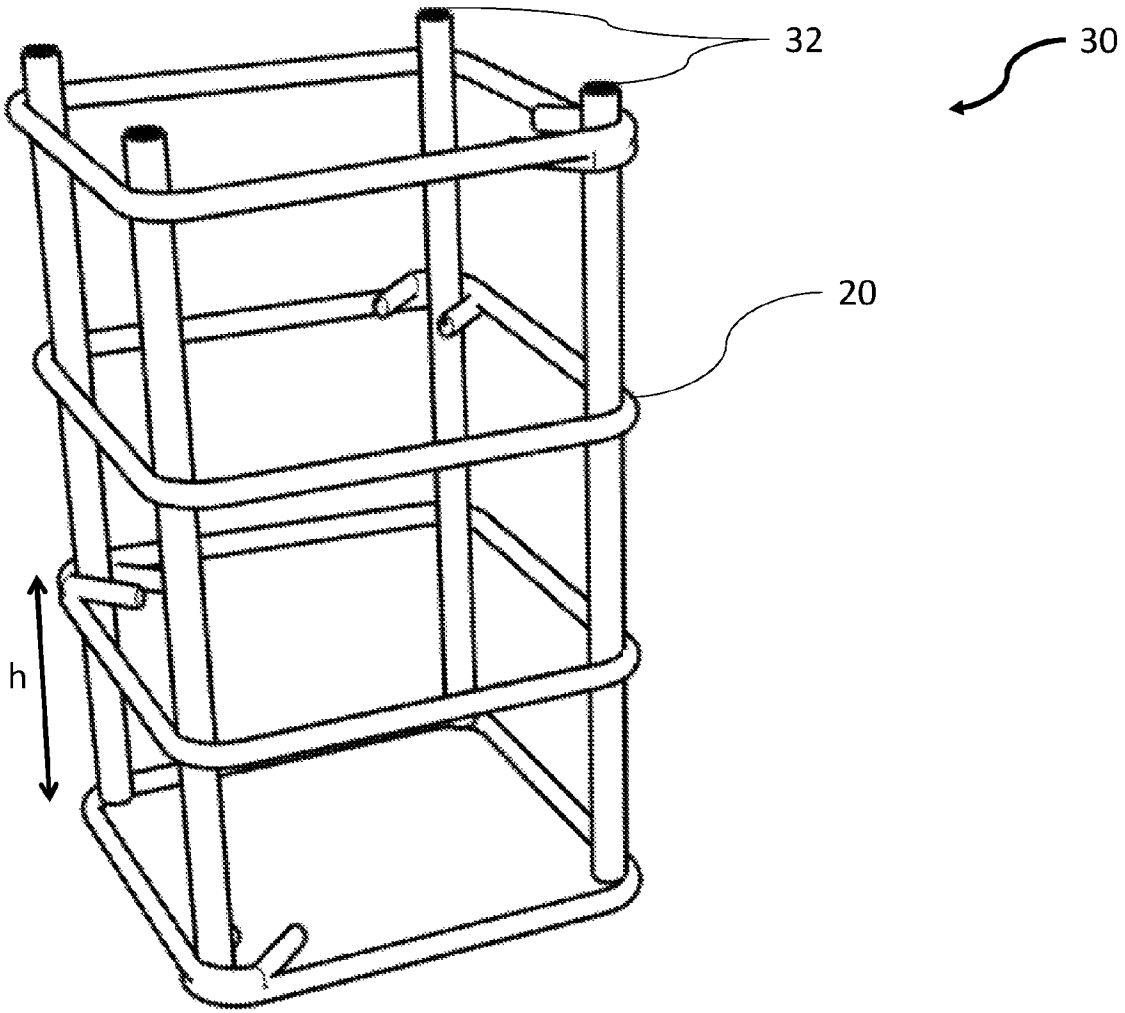
FIG.3 (PRIOR ART)
FIG. 3 (PRIOR ART) illustrates a plurality of conventional rectangular ties of FIG. 2(PRIOR ART) disposed around a plurality of vertical bars.
Figure 4:
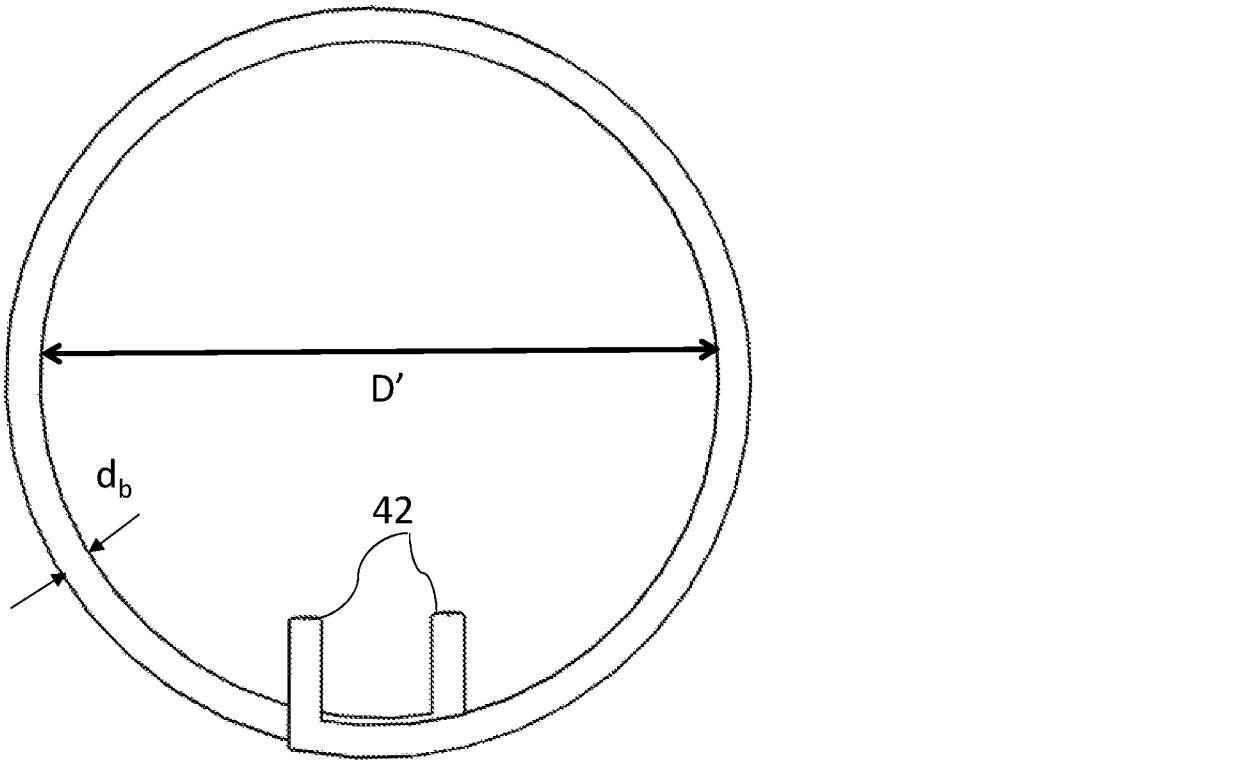
FIG.4 (PRIOR ART)
FIG. 4 (PRIOR ART) illustrates a conventional circular tie.
Figure 5:
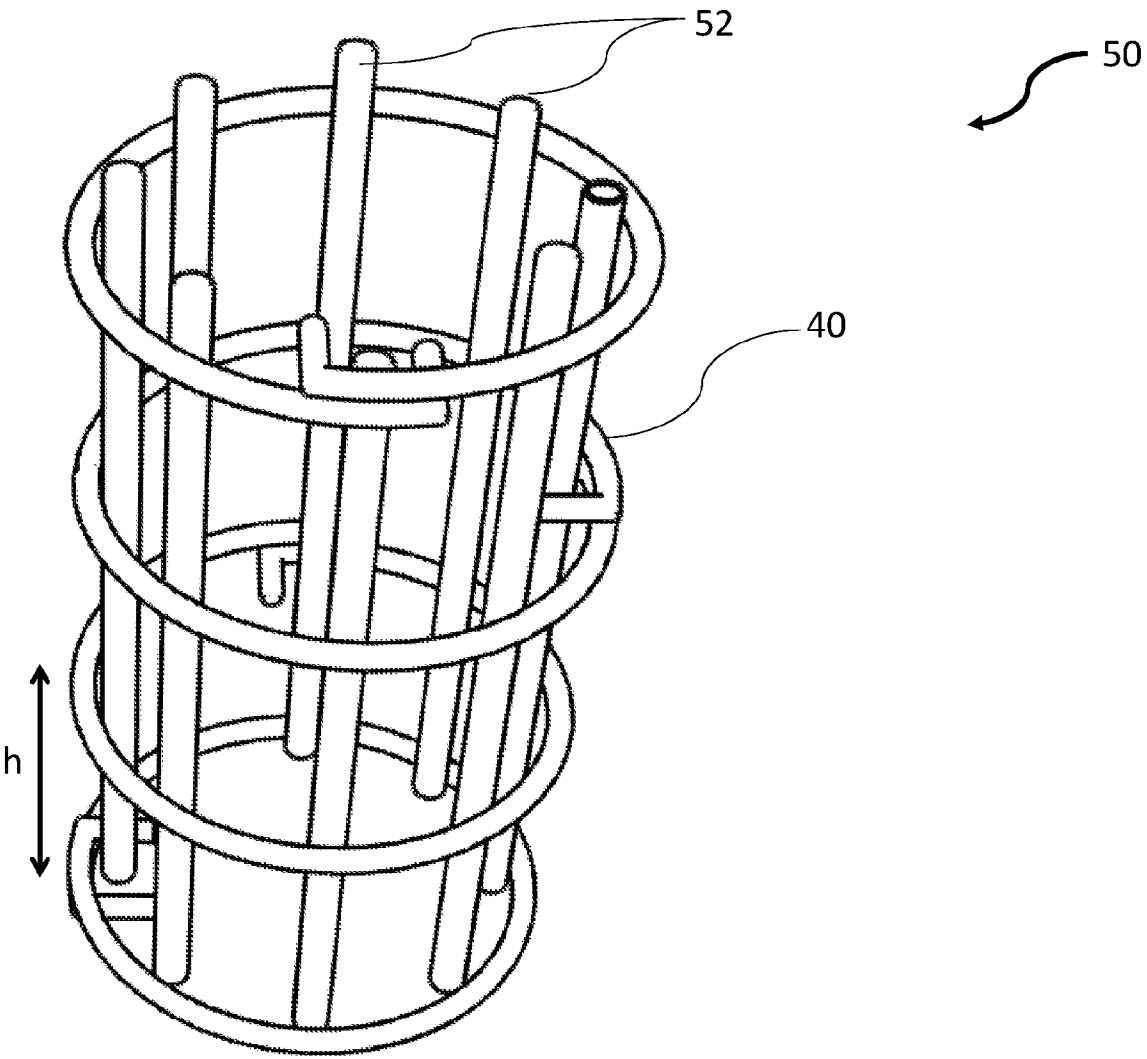
FIG.5 (PRIOR ART)
FIG. 5 (PRIOR ART) illustrates a plurality of conventional circular ties of FIG. 4 (PRIOR ART) disposed around a plurality of vertical bars.

The exemplary embodiments described herein detail for illustrative purposes are subject to many variations. It should be emphasized, however that the present invention is not limited to particular lateral reinforcement system and method for concrete structures as described. Rather, the principles of the present invention may be used with a variety of configurations and structural arrangements of the lateral reinforcement system. It is understood that various omissions, substitutions of equivalents are contemplated as circumstances may suggest or render expedient, but the present invention is intended to cover the application or implementation without departing from the spirit or scope of the its claims.

In the following description, for purposes of explanation, numerous specific details are set forth in order to provide a thorough understanding of the present invention. It will be apparent, however, to one skilled in the art that the present invention may be practiced without these specific details.

As used herein, the term 'plurality' refers to the presence of more than one of the referenced item and the terms 'a', 'an', and 'at least' do not denote a limitation of quantity, but rather denote the presence of at least one of the referenced item.

The present invention provides a lateral reinforcement system for concrete structures comprising structural bars. Such structural bars include vertical bars (for example, columns, piers, shear walls and the like) and horizontal bars (for example, beams, girders, and the like). For a person skilled in the art in the field of structural systems for buildings, bridges and bunkers, 'lateral reinforcement' as used herein is defined as the process used for holding the structural bars (horizontal bars and/or vertical bars) in proper alignment and to confine concrete and provide resistance to applied shear. As used herein, a 'vertical bar' refers to an upright structural member of metal in vertical members in buildings whose length is substantially greater than width. The vertical bars are usually employed for supporting a concentrated load in the buildings. Also, as used herein, a 'horizontal bar' refers to a reinforcing bar placed in a horizontal alignment along the length of the member that supports transverse load and transfers the load to vertical members.

The lateral reinforcement system of the present invention comprises a plurality of individual lateral reinforcement units, such as, ties, stirrups, rings, hoops, and the like. Also, for purposes of this disclosure and as known in the art, a lateral reinforcement unit in case of vertical bars is called a 'tie' and in case of horizontal bars is called a 'stirrup'. Hereinafter, for consistency in terminology in the description of the present invention, the individual lateral reinforcement units are referred to as 'reinforcement tie' or 'reinforcement ties'; and it will be evident to a person skilled in the art that the term 'reinforcement tie' or 'reinforcement ties' would collectively refer to one or more from the group of ties, stirrups, rings, hoops, and the like.

Specifically, the lateral reinforcement system of the present invention comprises a plurality ties forming a three-dimensional interwoven network around a plurality of axially disposed structural bars in a structure. Such a structure formed by the lateral reinforcement system around the structural bars when embedded in concrete, provides enhanced performance of concrete structures, constructability, enhanced load carrying capacity, enhanced earthquake resistance, enhanced energy absorption and saving in material (for example, steel) usage. Also, the present invention provides for a more efficient use of steel while providing enhancement of performance of reinforced concrete elements.

The lateral reinforcement system of the present invention comprises a plurality of reinforcement ties disposed at an inclination to the axially disposed structural bars. A pair of reinforcement ties of the plurality of reinforcement ties is disposed at mirror inclinations to each other. In the pair of reinforcement ties, the reinforcement ties cross each other at diametrically opposite corners of the reinforcement ties at diametrically opposite axially disposed structural bars, such that, a first reinforcement tie of the pair of reinforcement ties crosses from inside of a second reinforcement tie of the pair of reinforcement ties at one structural bar, and the second reinforcement tie crosses from inside of the first reinforcement tie at the diametrically opposite structural bar. The plurality of reinforcement ties forms a three-dimensional interwoven network around the axially disposed structural bars.

Different embodiments of the present invention with regard to the different shapes, size and configuration of the reinforcement ties are explained herein below.

Figure 6:
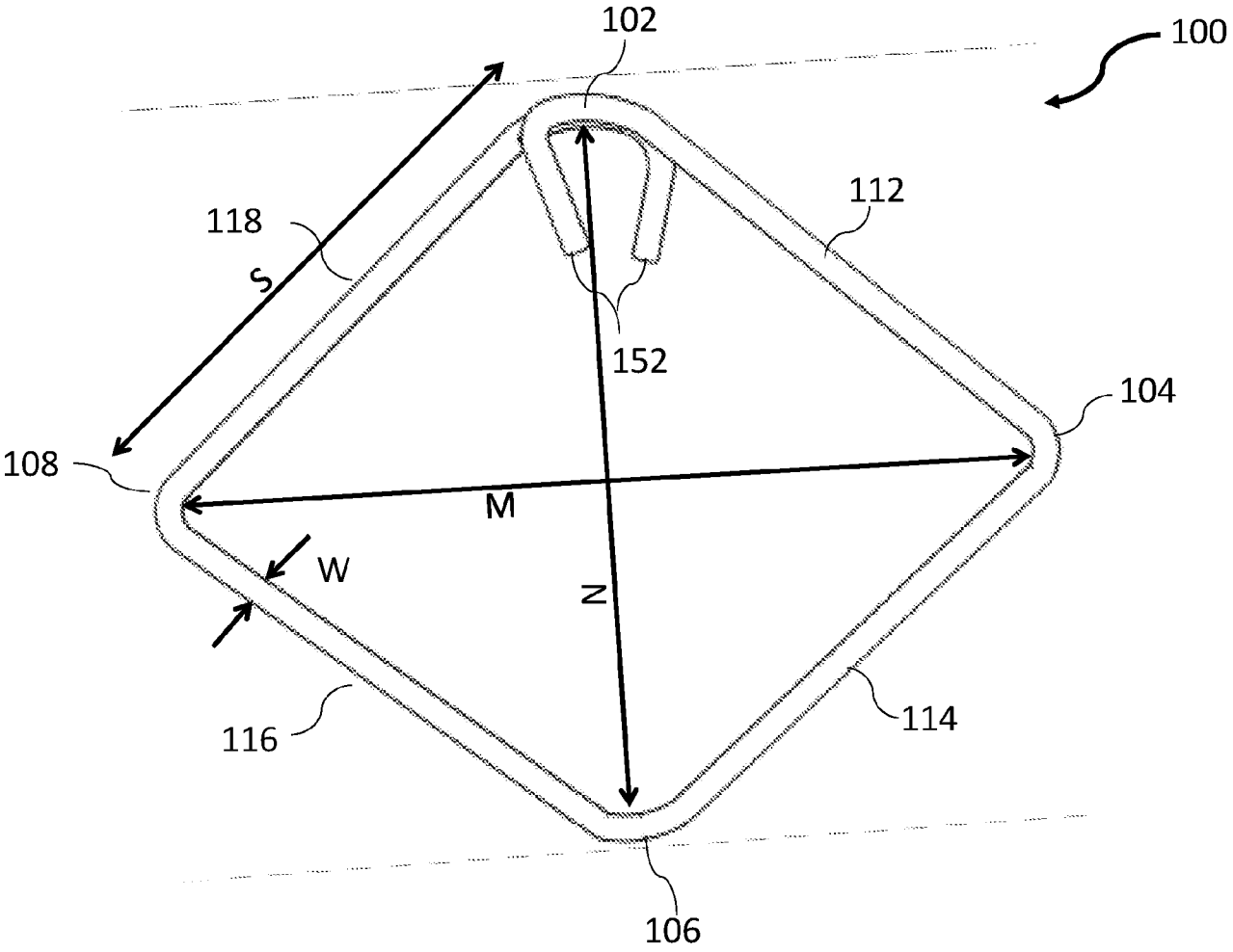
FIG. 6. illustrates a rhombical reinforcement tie, in accordance with an exemplary embodiment of the present invention.

Referring to FIG. 6, in one embodiment, illustrated is a rhombical reinforcement tie 100. As used herein, "rhombical reinforcement tie" refers to a reinforcement tie in shape of a rhombus or diamond (or any quadrilateral shape as per the shape of vertical member/horizontal member). The rhombical reinforcement tie 100 is made of solid steel bar (or any other metallic/non-metallic bar) having a circular cross section of diameter W. The rhombical reinforcement tie 100 comprises four corners 102, 104, 106 and 108; and four sides 112, 114, 116 and 118. Each side 112, 114, 116, 118 has a length S. As shown in FIG. 6, the rhombical reinforcement tie 100 has a diagonal dimension M along a major axis and a diagonal dimension N along a minor axis. It will be evident to a person skilled in the art that the dimension nomenclature W, S, M and N are only for illustration and description purposes and the invention is not limited by such dimension nomenclature.

Further, the rhombical reinforcement tie 100 comprises a dual hook member 152 disposed at one of the corners of the rhombical reinforcement tie 100. As shown in FIG. 6, the dual hook member 152 is disposed at the corner 102 of the rhombical reinforcement tie 100. The dual hook member 152 provides for anchoring the rhombical reinforcement tie 100 to the load bearing element of the structural bars. Further, the dual hook member 152 provides for engaging a corner of another rhombical reinforcement tie.

Figure 7:
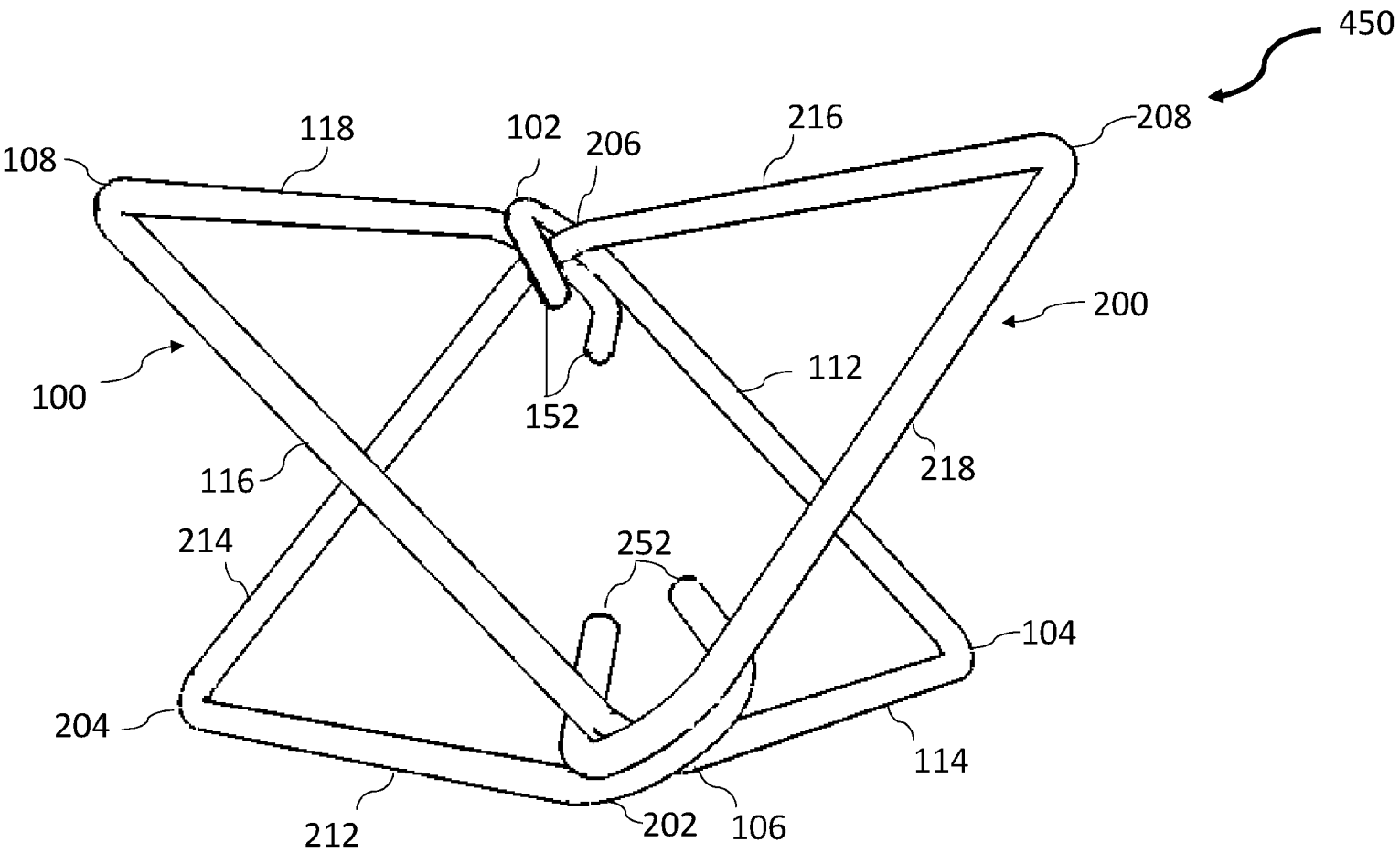
FIG. 7 illustrates a pair of rhombical reinforcement ties of FIG. 6 forming a reinforcement tie unit.

Referring to FIG. 7, illustrated is a pair of rhombical reinforcement ties of FIG. 6 forming a reinforcement tie unit 450. In FIG. 7, the rhombical reinforcement ties are a first rhombical reinforcement tie 100 and a second rhombical reinforcement tie 200. The second rhombical reinforcement tie 200 is similar to the first rhombical reinforcement tie 100 in shape and dimension, as described with reference to FIG. 6 (however, a mirrored image of reinforcement tie 100). Specifically, the second rhombical reinforcement tie 200 comprises four corners 202, 204, 206 and 208; and four sides 212, 214, 216 and 218. Further, the second rhombical reinforcement tie 200 comprises a dual hook member 252 at the corner 202 of the second rhombical reinforcement tie 200. The dual hook member 252 provides for anchoring the rhombical reinforcement tie 100 to the load bearing element of the structural bars. Further, the dual hook member 252 provides for engaging a corner of another rhombical reinforcement tie.

For forming the reinforcement tie unit 450, the rhombical reinforcement ties 100, 200 are disposed at mirror inclinations to each other, such that, the rhombical reinforcement ties are rotated about diagonal N (not shown in the FIG.) and cross each other at diametrically opposite corners of the rhombical reinforcement ties, thereby configuring two non-intersecting crossings.

In a first crossing, the first rhombical reinforcement tie 100 crosses from inside of the second rhombical reinforcement tie 200. Specifically, the corner 106 of the first rhombical reinforcement tie 100 is on the inside and the corner 202 of the second rhombical reinforcement tie 200 is on outside. In this configuration, the dual hook 252 of the second rhombical reinforcement tie 200 engages the corner 106 of the first rhombical reinforcement tie 100.

In a second crossing, the second rhombical reinforcement tie 200 crosses from inside of the first rhombical reinforcement tie 100. Specifically, the corner 206 of the second rhombical reinforcement tie 200 is on the inside and the corner 102 of the first rhombical reinforcement tie 100 is on outside. In this configuration, the dual hook 152 of the first rhombical reinforcement tie 100 engages the corner 206 of the second rhombical reinforcement tie 200.

Figure 8:
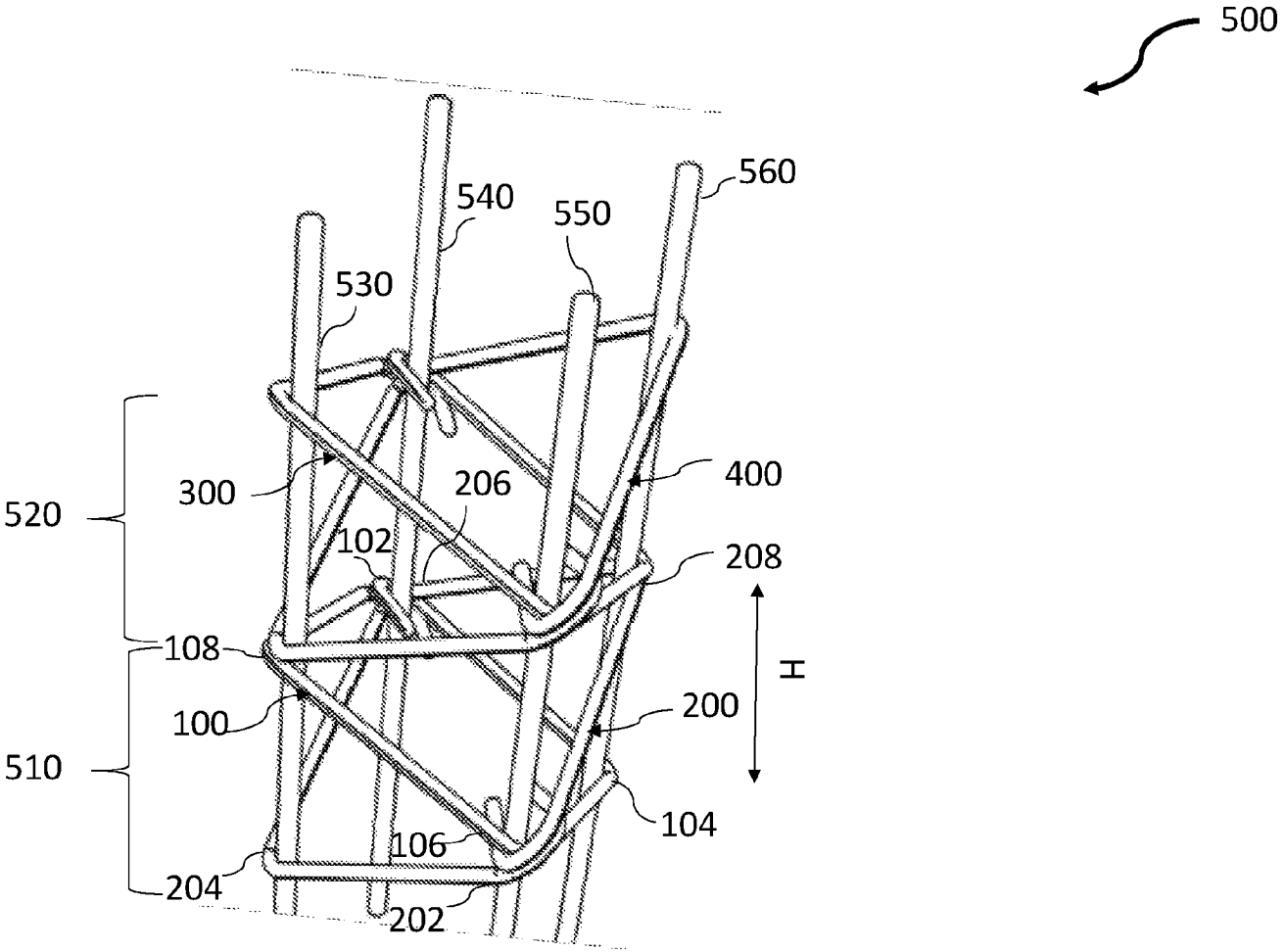
FIG. 8 illustrates a lateral reinforcement system comprising a plurality of rhombical reinforcement ties of FIG. 6 forming a three-dimensional interwoven network around a plurality of axially disposed structural bars.

Now, referring to FIG. 8, illustrated is a lateral reinforcement system 500 comprising a plurality of rhombical reinforcement ties of FIG. 6 forming a three-dimensional interwoven network around a plurality of axially disposed structural bars 530, 540, 550 and 560. In the lateral reinforcement system 500, the rhombical reinforcement ties 100, 200, 300 and 400 are disposed at an inclination to the axially disposed structural bars 530, 540, 550 and 560. That is, the rhombical ties 100, 200, 300, 400 are disposed at an angle to the axially disposed structural bars 530, 540, 550 and 560 making it also inclined at an angle to a surface on which the axially disposed structural bars 530, 540, 550 and 560 are disposed. The rhombical reinforcement ties 300 and 400 are similar to the rhombical reinforcement ties 100 and 200 as described with reference to FIGS. 6 and 7.

In this configuration, the reinforcement ties in a pair of reinforcement ties cross each at diametrically opposite corners of the reinforcement ties at diametrically opposite structural bars, such that, a first reinforcement tie of the pair of reinforcement ties crosses from inside of a second reinforcement tie of the pair of reinforcement ties at one structural bar, and the second reinforcement tie crosses from inside of the first reinforcement tie at the diametrically opposite structural bar. For example, in a first crossing, the rhombical reinforcement tie 100 (first reinforcement tie) crosses from inside of the rhombical reinforcement tie 200 (second reinforcement tie) at the structural bar 550. In this crossing, the corner 106 of the rhombical reinforcement tie 100 is on the inside and the corner 202 of the rhombical reinforcement tie 200 is on outside. Further, in a second crossing, the second rhombical reinforcement tie 200 (second reinforcement tie) crosses from inside of the first rhombical reinforcement tie 100 (first reinforcement tie) at diametrically opposite structural bar 540. In this crossing, the corner 206 of the second rhombical reinforcement tie 200 is on the inside and the corner 102 of the first rhombical reinforcement tie 100 is on outside. Accordingly, the pair of rhombical reinforcement ties 100, 200 is configured to form two non-intersecting crossings at the diametrically opposite structural bars 540, 550.

The pair of rhombical reinforcement ties 300, 400 is configured in a similar manner.

For forming the lateral reinforcement system 500, a plurality of reinforcement tie units (such as the reinforcement tie unit 450) are disposed on and the about the axially disposed structural bars 530, 540, 550, and 560. The process comprises placing a first reinforcement tie unit and then another reinforcement tie unit on top of the first reinforcement tie unit, and so on. For example, the first reinforcement tie unit (herein referred to as reinforcement tie unit 450) is formed by rhombical reinforcement ties 100, 200 configured about each other and about the axially disposed structural bars 530, 540, 550, and 560 as explained above. Next, a second reinforcement tie unit is formed by rhombical reinforcement ties 300, 400 and is placed over the first reinforcement tie unit 450.

In this formation, the plurality of rhombical reinforcement ties 100, 200, 300, and 400 form a three-dimensional interwoven network around the axially disposed structural bars 530, 540, 550, and 560. The three-dimension interwoven network is a collection of sub-interwoven networks formed by individual reinforcement tie units. For example, as illustrated in FIG. 8, a first sub-interwoven network 510 is formed by the first reinforcement tie unit 450, and a second sub-interwoven network 520 is formed by the second reinforcement tie unit (not numbered herein). Although, in FIG. 8 herein, illustrated are only two reinforcement tie units forming two sub-interwoven networks, it will be evident to a person skilled in the art that the lateral reinforcement system can comprise more than two sub-interwoven networks as per the shape and size requirements of the structural bars and reinforcement requirement for a concrete structure.

Further, as illustrated in FIG. 8, the rhombical reinforcement ties 100, and 200 are at mirror inclinations to each other such that a distance (spacing) between corners of the rhombical ties 100, and 200 on the same structural bar is a pre-determined height H. Specifically, as illustrated in FIG. 8, 'H' is the distance between corner 104 of the rhombical reinforcement tie 100 and corner 208 of the rhombical reinforcement tie 200 on the structural bar 560.

Figure 9A:
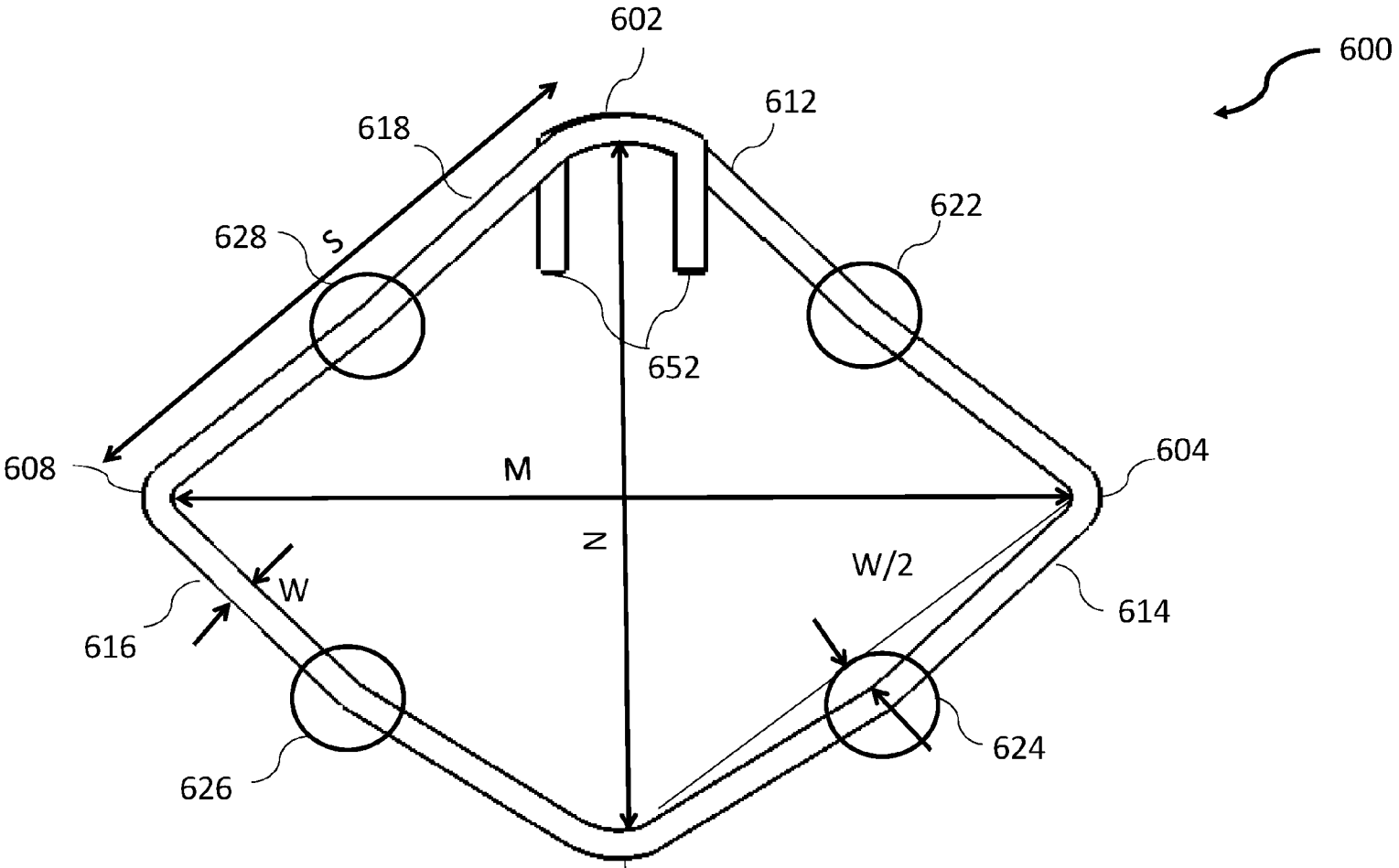
FIGS. 9A and 9B illustrates a pair of mid-side kinked rhombical reinforcement ties, in accordance with another exemplary embodiment of the present invention.
Figure 9B:
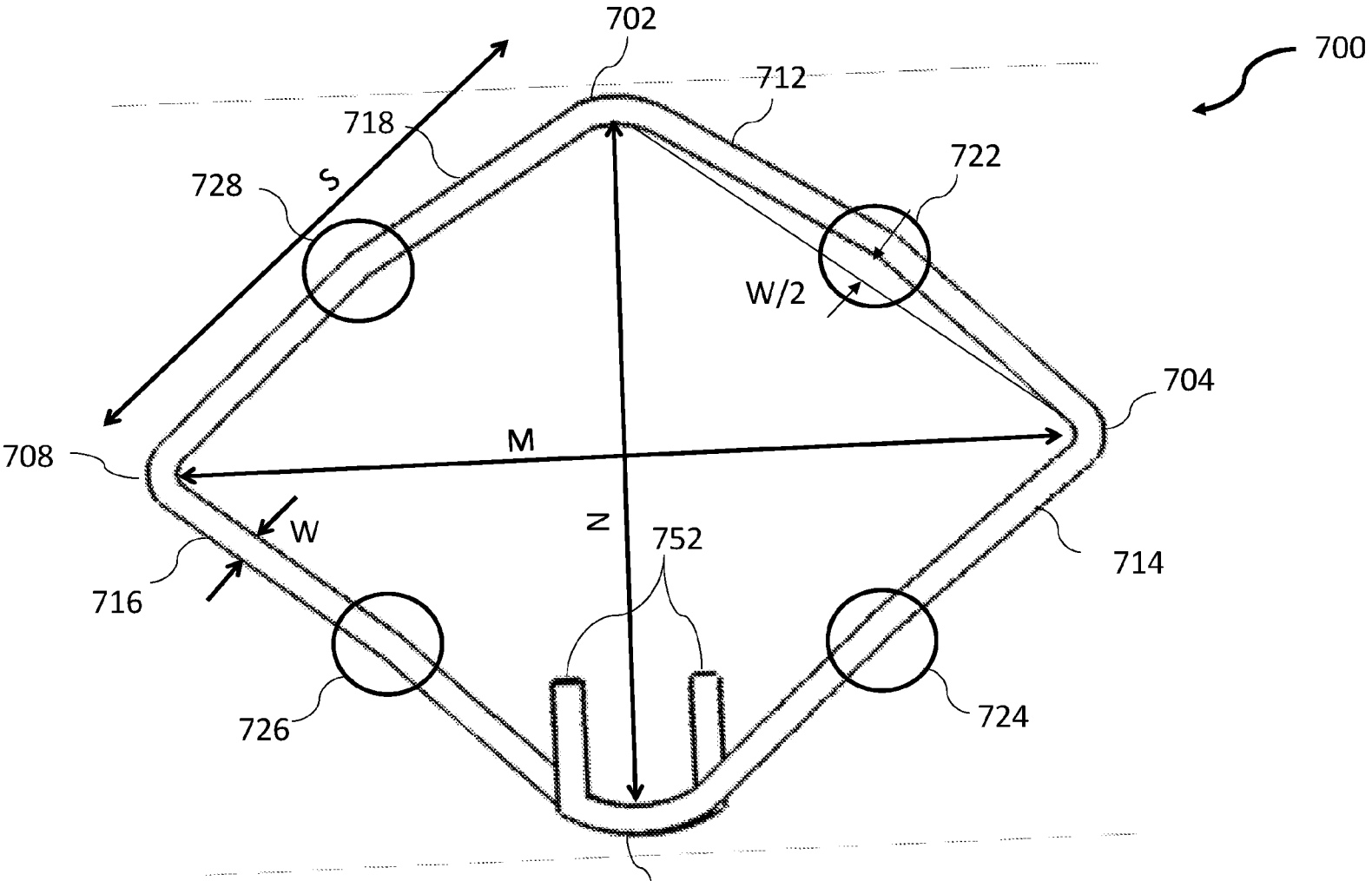

Referring to FIGS. 9A and 9B, in another embodiment, illustrated is a pair of mid-side kinked rhombical reinforcement ties 600 and 700 respectively. As used herein, "mid-side kinked rhombical reinforcement tie" refers to a tie in shape of rhombus or diamond having kink at the midpoint of the each four sides of the rhombical reinforcement tie. Further as used herein, "kink" is defined as a sharp twist or curve or deviation in the sides of something (here rhombical tie/stirrup) that is otherwise straight.

The reinforcement tie 600 is made of steel bar (or any other metallic/non-metallic bar) having a circular cross section of diameter W. The reinforcement tie 600 comprises four corners 602, 604, 606 and 608; and four sides 612, 614, 616 and 618. Each side 612, 614, 616 and 618 has a length S. As shown in FIG. 9A, the reinforcement tie 600 has a diagonal dimension M along a major axis and a diagonal dimension N along a minor axis. It will be evident to a person skilled in the art that the dimension nomenclature W, S, M and N are only for illustration and description purposes and the invention is not limited by such dimension nomenclature.

Further, the reinforcement tie 600 comprises a dual hook member 652 disposed at one of the corners of the reinforcement tie 600. As shown in FIG. 9A, the dual hook member 652 is disposed at the corner 602 of the reinforcement tie 600. The dual hook member 652 provides for anchoring the reinforcement tie 600 to the load bearing element of the structural bars. Further, the dual hook member 652 provides for engaging a corner of another reinforcement tie.

Further, the reinforcement tie 600 comprises of kinks 622, 624, 626 and 628 at the midpoint of the four sides 612, 614, 616 and 618 respectively having a deviation dimension W/2, that is, a kink with a deviation dimension of half the cross-sectional diameter of the bar making the reinforcement tie 600. It will be evident to a person skilled in the art that the deviation dimension is not limited to W/2 and can vary as per the configurational and reinforcement requirements.

As used herein, kinks are formed on reinforcement ties is to facilitate crossing of the other reinforcement ties in a vertical planes. As explained further herein, the reinforcement ties themselves form a geometric pattern with kinks all in one plane. The pattern is formed by crossing the ties in vertical plane with crossing points identified by the kinks.

Specifically the kink 622 at the side 612 is a low point, the kink 624 at the side 614 is a high point, the kink 626 at the side 616 is a high point and the kink 628 at the side 618 is a low point. As used herein, "high point" refers to a point on a side of the reinforcement tie where the kink sharp twists or curves to have a high deviation. Also, as used herein, "low point" refers to a point on a side of the reinforcement tie where the kink sharp twists or curves to have a low deviation. For the purposes of description, the kinks 622, 628 are referred to as lower kinks; and the kinks 624, 626 are referred to as upper kinks.

Similarly, the reinforcement tie 700 as described in FIG. 9B is a mirror image of the reinforcement tie 600 comprising hooks 752, and kinks 722, 724, 726 and 728 at the midpoint of the four sides 712, 714, 716 and 718 respectively having deviation equal to W/2. Further, the reinforcement tie 700 comprises four corners 702, 704, 706 and 708. For the purposes of description, the kinks 724, 726 are referred to as lower kinks; and the kinks 722, 728 are referred to as upper kinks.

Figure 10A:
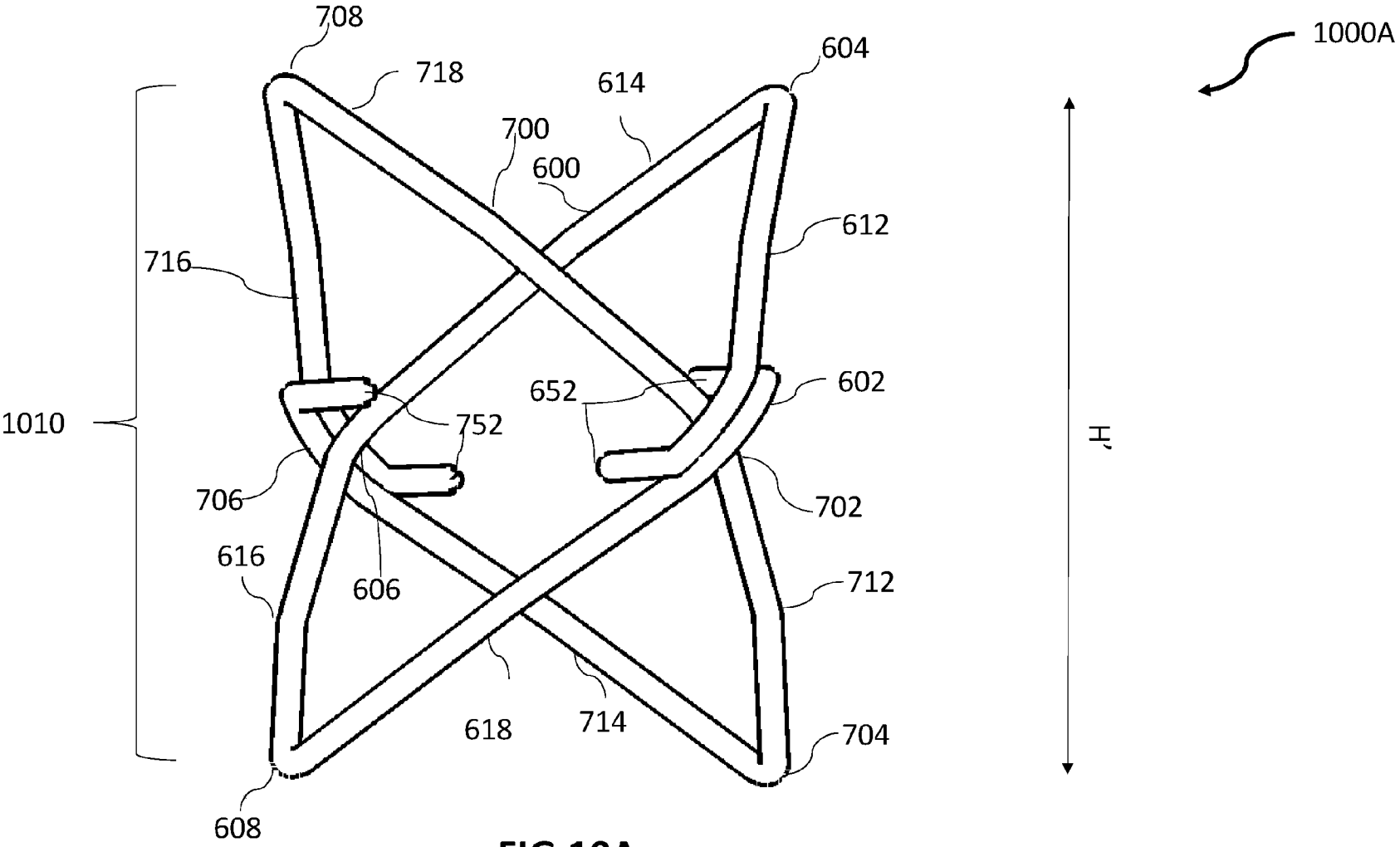
FIG. 10A illustrates the pair of mid-side kinked rhombical reinforcement ties of FIGS. 9A and 9B forming a reinforcement tie unit.

Referring to FIG. 10A, illustrates the pair of mid-side kinked rhombical reinforcement ties 600 and 700 of FIGS. 9A and 9B respectively forming a reinforcement tie unit 1000A. For forming the reinforcement tie unit 1000A, the reinforcement ties 600, 700 are disposed at mirror inclinations to each other, such that, the reinforcement ties cross each other at diametrically opposite corners of the other reinforcement ties.

As illustrated in FIG. 10A, the reinforcement tie 600 (first reinforcement tie) crosses from inside of the reinforcement tie 700 (second reinforcement tie) at the respective corners 606, and 706, and the reinforcement tie 700 crosses from inside of the reinforcement tie 600 at the respective corners 702, and 602, configuring two non-intersecting crossings. In a first crossing, the corner 606 of the reinforcement tie 600 is on the inside and the corner 706 of the reinforcement tie 700 is on outside. In this configuration the dual hook 752 of the reinforcement tie 700 engages the corner 606 of the reinforcement tie 600. In a second crossing, the corner 702 of the reinforcement tie 700 is on the inside and the corner 602 of the rhombical reinforcement tie 600 is on outside. In this configuration, the dual hook 652 of the reinforcement tie 600 engages the corner 702 of the reinforcement tie 700.

Further, as illustrated in FIG. 10A, the reinforcement ties 600, 700 are at mirror inclinations to each other such that a distance (spacing) between corners of the rhombical ties 600, and 700 on the same structural bar is a pre-determined height H'. Specifically, as illustrated in FIG. 10A, H' is the distance between corner 704 of the reinforcement tie 700 and corner 604 of the reinforcement tie 600.

Figure 10B:
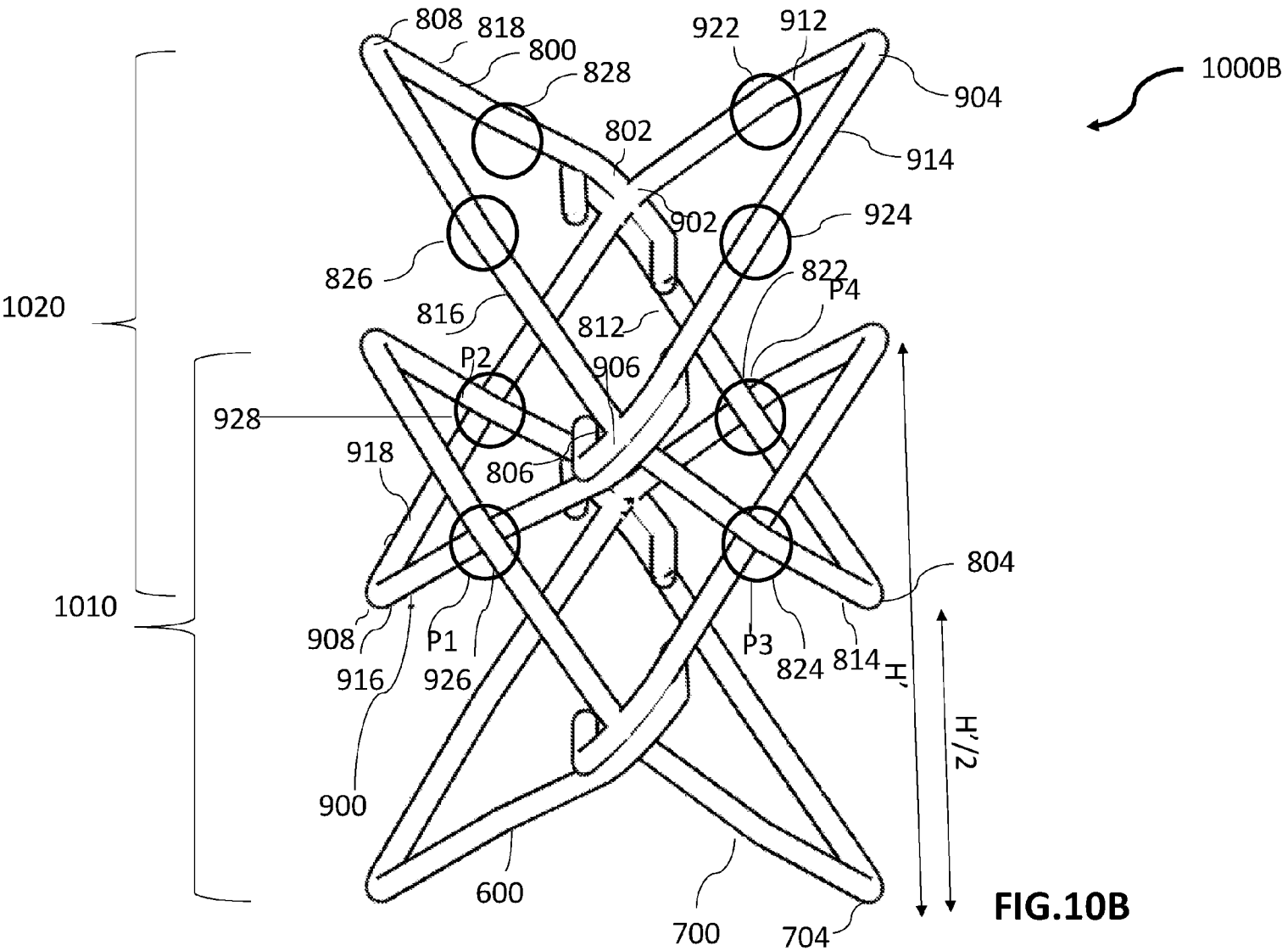
FIG. 10B illustrates two pairs of mid-side kinked rhombical reinforcement ties of FIGS. 9A and 9B forming multi-layered reinforcement tie unit, each pair having intersection with subsequent pair at mid side.

Now, referring to FIG. 10B, illustrated are two pairs of mid-side kinked rhombical reinforcement ties of FIGS. 9A, 9B forming a multi-layered reinforcement tie unit 1000B. The multi-layered reinforcement tie unit is only an unassembled representation (still not configured around the axially disposed structural bars) of the lateral reinforcement system 1090 of FIG. 10C.

As illustrated in FIG. 10B, mid-side kinked rhombical reinforcement tie 800 comprises hooks 852, and kinks 822, 824, 826 and 828 on the midpoint having deviation equal to W/2 (not shown in FIG.) at the four sides 812, 814, 816 and 818 respectively of the individual reinforcement tie 800. Further, the individual reinforcement tie 800 comprises four corners 802, 804, 806 and 808. Similarly, mid-side kinked rhombical reinforcement tie 900 comprises hooks 952, kinks 922, 924, 926 and 928 on the midpoint having deviation equal to W/2 (not shown in FIG.) at the four sides 912, 914, 916 and 918 respectively of the individual reinforcement tie 900 and comprises four corners 902, 904, 906 and 908.

For forming the multi-layered reinforcement tie unit 1000B, two-sub interwoven networks 1010 and 1020 are placed one above the other as shown in the FIG. 10B. The two-sub interwoven networks 1010 and 1020 are placed one above the other in such a way such that the distance between the corner 804 of reinforcement tie 800 and corner 704 of tie 700 is approximately equal to H'/2. It will be evident to a person skilled in the art that the distance is not limited to H'/2 and can vary as per the configurational and reinforcement requirements.

Specifically, the side 916 of reinforcement tie 900 crosses the side 716 (not shown in the figure) of the reinforcement tie 700 at crossing point P1. The crossing at point Pb involves meeting of the upper kink 926 of reinforcement tie 900 and lower kink 726 (not shown in the figure) of reinforcement tie 700. Further, the side 918 of reinforcement tie 900 crosses the side 718 (not shown in the figure) of the reinforcement tie 700 having a crossing at point P2. The crossing at point P2 involves meeting of the lower kink 928 of reinforcement tie 900 and upper kink 728 (not shown in the figure) of reinforcement tie 700. Again, the side 814 of reinforcement tie 800 crosses the side 614 (not shown in the figure) of the reinforcement tie 600 having a crossing at point P3. The crossing at point P3 involves meeting of the lower kink 824 of reinforcement tie 800 and upper kink 624 (not shown in the figure) of the reinforcement tie 600. Further, the side 812 of the reinforcement tie 800 crosses the side 612 (not shown in the figure) of the reinforcement tie 600 having a crossing at point P4. The crossing at point 4 involves meeting of the lower kink 622 (not shown in the figure) of the reinforcement tie 600 and upper kink 822 of the reinforcement tie 800.

It will be apparent, however, to one skilled in the art that the multi-layered reinforcement tie unit 1000B may contain one or more such sub interwoven networks placed one above the other in the similar pattern as described.

Figure 10C:
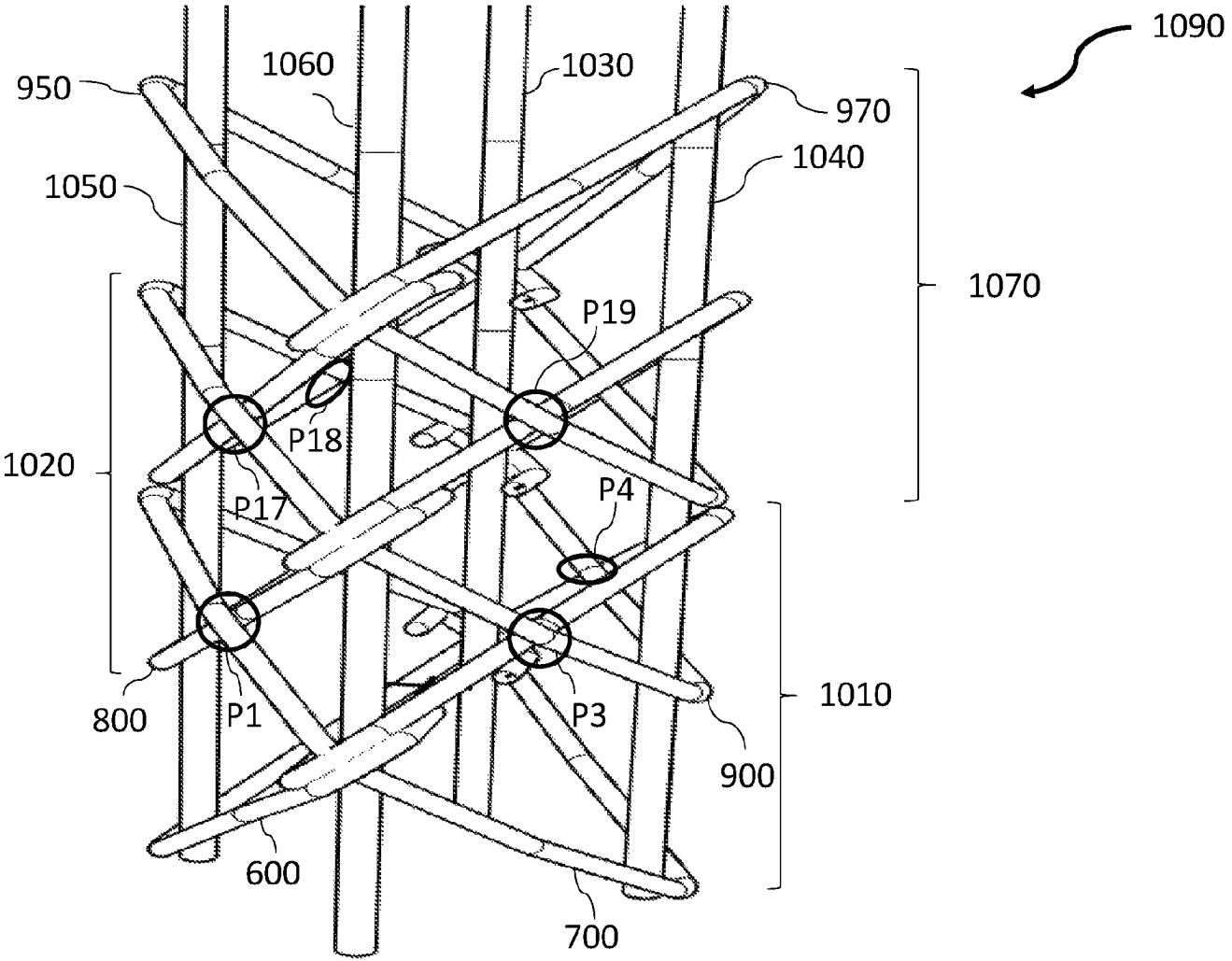
FIG. 10C illustrates a lateral reinforcement system comprising a plurality of mid-side kinked rhombical reinforcement ties of FIGS. 9A and 9B forming multi-layered reinforcement tie unit (as in FIG. 10B) and consequently a three-dimensional interwoven network around a plurality of axially disposed structural bars.

Now, referring to FIG. 10C, illustrated is a lateral reinforcement system 1090 (assembled form) comprising a plurality of mid-side kinked rhombical reinforcement ties of FIGS. 9A, 9B forming a three-dimensional interwoven network around a plurality of axially disposed structural bars 1030, 1040, 1050 and 1060. In the lateral reinforcement system 1090, reinforcement ties 600, 700, 800, 900, 950 and 970 are disposed at an inclination to the axially disposed structural bars 1030, 1040, 1050 and 1060. That is, the reinforcement ties 600, 700, 800, 900, 950 and 970 are disposed at an angle to the axially disposed structural bars 1030, 1040, 1050 and 1060 making it also inclined at an angle to a surface on which the axially disposed structural bars 1030, 1040, 1050 and 1060 are disposed. The reinforcement ties 950 and 970 are similar to the reinforcement ties 600, 700, 800, 900 as described above.

In this configuration, the reinforcement ties in a pair of reinforcement ties cross each at diametrically opposite corners of the reinforcement ties at diametrically opposite structural bars, such that, a first reinforcement tie of the pair of reinforcement ties crosses from inside of a second reinforcement tie of the pair of reinforcement ties at one structural bar, and the second reinforcement tie crosses from inside of the first mid-side reinforcement tie at the diametrically opposite structural bar.

For example, in a first crossing of the pair of reinforcement ties 600, 700, reinforcement tie 600 (first reinforcement tie) crosses from inside of the reinforcement tie 700 (second reinforcement tie) at the structural bar 1030. In this crossing, the corner 606 of the reinforcement tie 100 is on the inside and the corner 706 of the reinforcement tie 700 is on outside. Further, in a second crossing, the reinforcement tie 700 (second reinforcement tie) crosses from inside of the reinforcement tie 600 (first reinforcement tie) at diametrically opposite structural bar 1060. In this crossing, the corner 702 of the reinforcement tie 700 is on the inside and the corner 602 of the reinforcement tie 600 is on outside. Accordingly, the pair of reinforcement ties 600 and 700 is configured to form two non-intersecting crossings at the diametrically opposite structural bars 1030 and 1060. Similarly, the pair of reinforcement ties 800 and 900 is configured to form two non-intersecting crossings at the diametrically opposite structural bars 1030 and 1060. Also, the pair of reinforcement ties 950 and 970 is configured to form two non-intersecting crossings at the diametrically opposite structural bars 1030 and 1060.

Additionally, the reinforcement ties cross each other at the kinks formed on corresponding reinforcement ties. Such crossing of reinforcement ties has been explained above with reference to FIG. 10B at points P1, P2 (not labeled), P3, and P4. It will be apparent from the illustration in FIG. 10C, that due to the presence of more reinforcement ties in the lateral reinforcement system 1090, there are additional crossing points (such as, P17, P18, P19, and other crossing points (not labeled)) at which the reinforcement ties cross each other at the kinks formed on corresponding reinforcement ties.

For forming the lateral reinforcement system 1090, a plurality of mid-side kinked reinforcement tie units (such as the mid-side kinked reinforcement tie units 600, 700, 800, 900, 950 and 970) are disposed on and the about the axially disposed structural bars 1030, 1040, 1050 and 1060. The process comprises placing a first mid-side kinked reinforcement tie unit and then second mid-side kinked reinforcement tie unit on top of the first reinforcement tie unit, such that the kinks present in the lower half part of the second mid-side kinked reinforcement tie unit crosses the kinks present in the upper half part of the first mid-side kinked reinforcement tie unit and so on.

In this formation, the plurality of the mid-side kinked rhombical reinforcement ties 600, 700, 800, 900, 950 and 970 form a three-dimensional interwoven network around the axially disposed structural bars 1030, 1040, 1050 and 1060. The three-dimension interwoven network is a collection of sub-interwoven networks 1010, 1020, 1070 formed by combining individual mid-side kinked reinforcement tie units.

Figure 11:
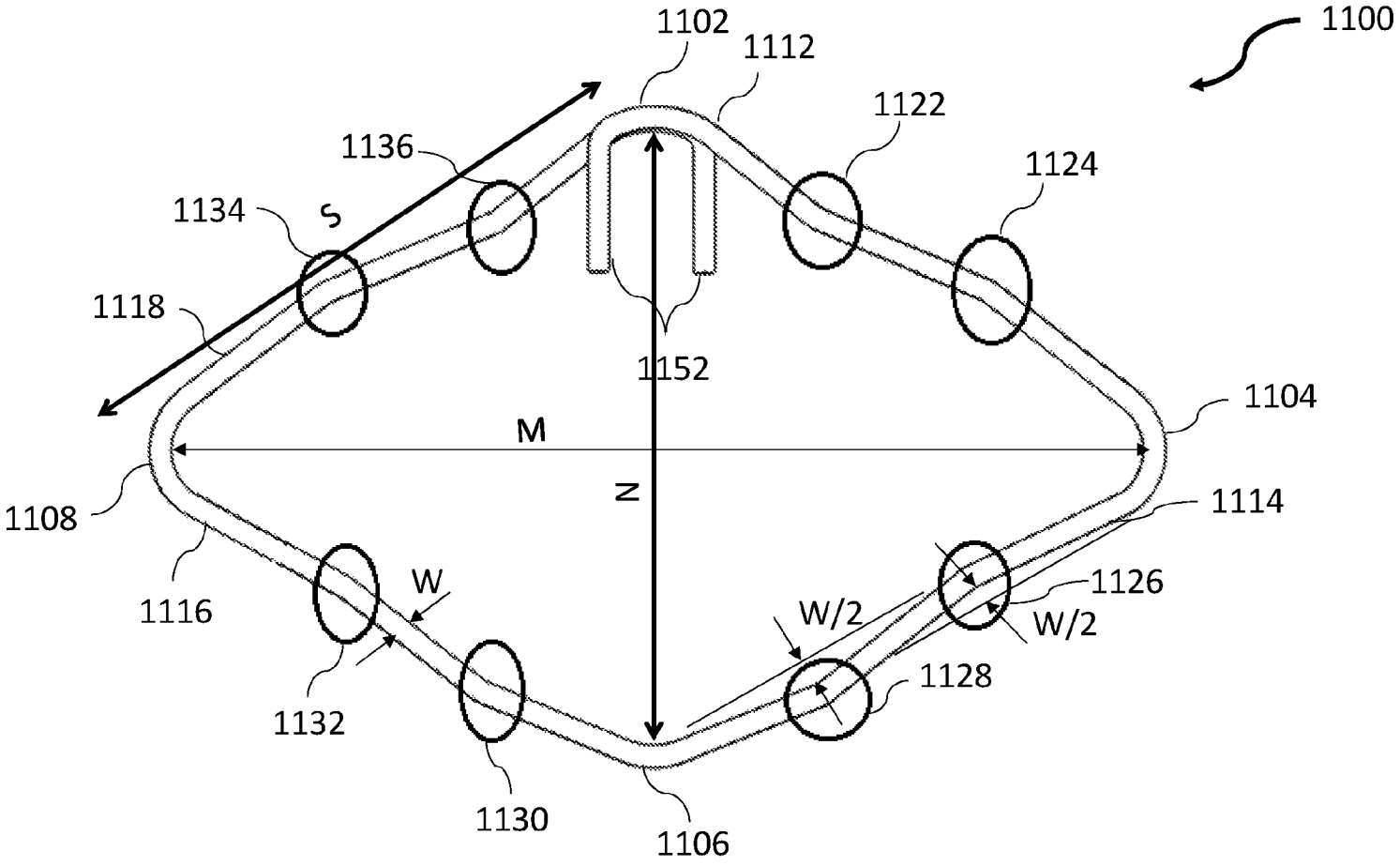
FIGS. 11 and 12 illustrate a pair of one-third side kinked rhombical reinforcement ties, in accordance with another exemplary embodiment of the present invention.
Figure 12:
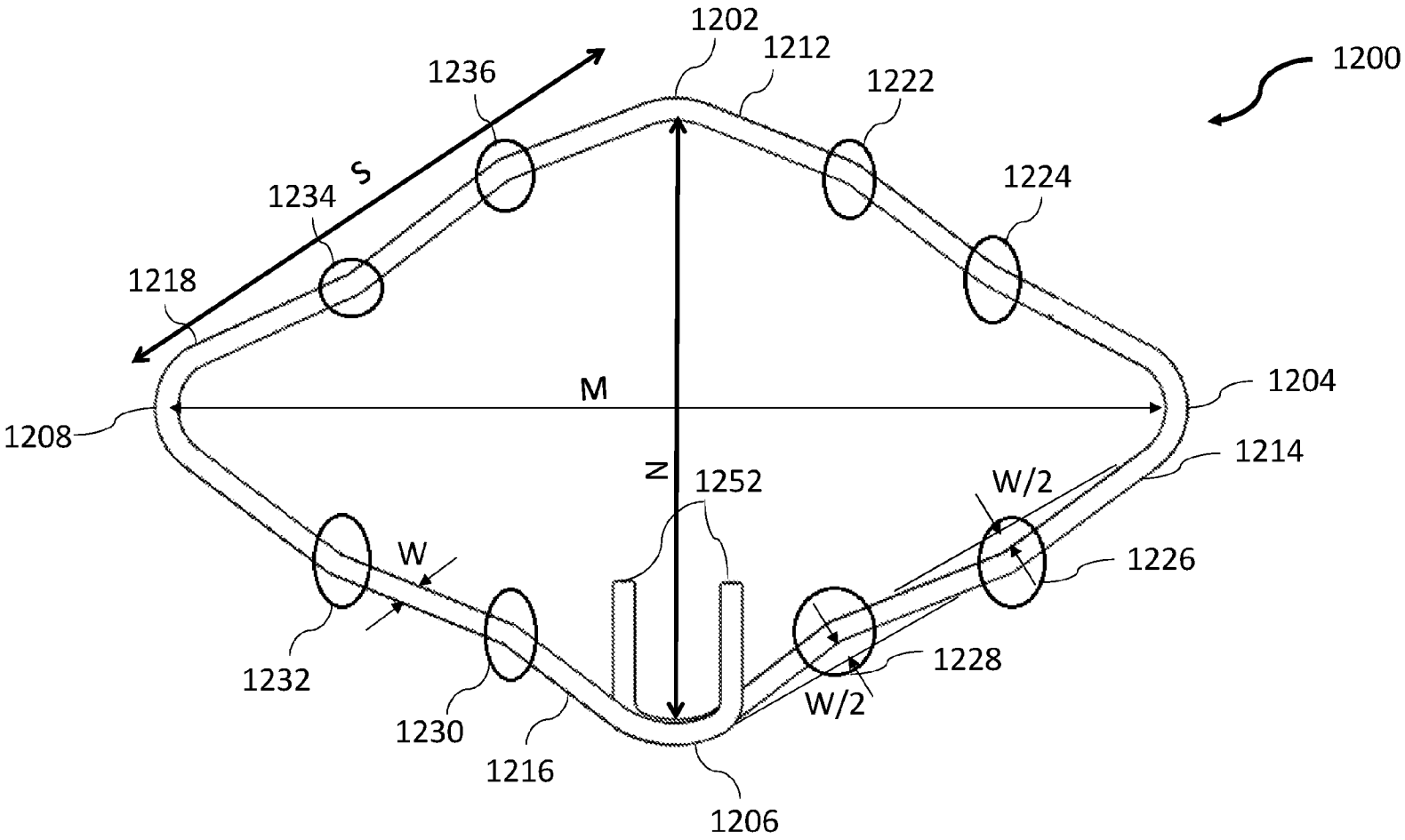

Referring to FIGS. 11 and 12, in another embodiment, illustrated is a pair of one-third side kinked rhombical reinforcement ties 1100 and 1200 respectively. As used herein, "one-third side kinked rhombical reinforcement tie" refers to a tie in shape of rhombus or diamond having kinks at the one-third point of the each of the four sides of the rhombical reinforcement tie.

The reinforcement tie 1100 as described in FIG. 11 is made of steel bar (or any other metallic/non-metallic bar) having a circular cross section of diameter W. Reinforcement tie 1100 comprises four corners 1102, 1104, 1106 and 1108; and four sides 1112, 1114, 1116 and 1118. Each side 1112, 1114, 1116 and 1118 has a length S. As shown in FIG. 11, the reinforcement tie 1100 has a diagonal dimension M along a major axis and a diagonal dimension N along a minor axis. It will be evident to a person skilled in the art that the dimension nomenclature W, S, M and N are only for illustration and description purposes and the invention is not limited by such dimension nomenclature.

Further, the reinforcement tie 1100 comprises a dual hook member 1152 disposed at one of the corners of the reinforcement tie 1100. As shown in FIG. 11, the dual hook member 1152 is disposed at the corner 1102 of the reinforcement tie 1100. The dual hook member 1152 provides for anchoring the one-third side kinked rhombical reinforcement tie 1100 to the load bearing element of the structural bars. Further, the dual hook member 1152 provides for engaging a corner of another reinforcement tie.

Further, the reinforcement tie 1100 comprises of kinks 1122 and 1124 on every one-third point of the side 1112, thereby providing deviation equal to W/2. Accordingly, the side 1112 comprises kinks with a deviation dimension of half the cross-sectional diameter of the bar making the reinforcement tie 1100. It will be evident to a person skilled in the art that the deviation dimension is not limited to W/2 and can vary as per the configurational and reinforcement requirements.

Similarly, the reinforcement tie 1100 comprises: kinks 1126 and 1128 at side 1114, kinks 1130 and 1132 at the side 1116; kinks 1130 and 1132 at the side 1116; and kinks 1134 and 1136 at the side 1118.

Specifically, the kinks 1122, 1126, 1132 and 1136 on the sides 1112, 1114, 1116 and 1118 respectively are the low points. The kinks 1124, 1128, 1130 and 1134 on the sides 1112, 1114, 1116 and 1118 respectively are the high points. As used herein, "high point" refers to a point on a side of the reinforcement tie where the kink sharp twists or curves to have a high deviation. Also, as used herein, "low point" refers to a point on a side of the reinforcement tie where the kink sharp twists or curves to have a low deviation.

Now, as illustrated in FIG. 12, and similar to reinforcement tie 1100 of FIG. 11, the reinforcement tie 1200 is made of steel bar (or any other metallic/non-metallic bar) having a circular cross section of diameter W. Reinforcement tie 1200 comprises four corners 1202, 1204, 1206 and 1208; and four sides 1212, 1214, 1216 and 1128. Each side 1212, 1214, 1216 and 1218 has a length S. As shown in FIG. 12, the reinforcement tie 1200 has a diagonal dimension M along a major axis and a diagonal dimension N along a minor axis. It will be evident to a person skilled in the art that the dimension nomenclature W, S, M and N are only for illustration and description purposes and the invention is not limited by such dimension nomenclature.

Further, the reinforcement tie 1200 comprises a dual hook member 1252 disposed at one of the corners of the reinforcement tie 1200. As shown in FIG. 11, the dual hook member 1252 is disposed at the corner 1202 of the reinforcement tie 1200. The dual hook member 1252 provides for anchoring the one-third side kinked rhombical reinforcement tie 1200 to the load bearing element of the structural bars. Further, the dual hook member 1252 provides for engaging a corner of another reinforcement tie.

The reinforcement tie 1200 is a mirror image of the reinforcement tie 1100.

The reinforcement tie 1200 further comprises: kinks 1222 and 1224 at side 1212; kinks 1226 and 1228 at side 1214; kinks 1230 and 1232 at side 1216; and kinks 1234 and 1236 at side 1218. Also, as illustrated, the kinks provide a deviation equal to W/2. Specifically, the kinks 1222, 1226, 1232 and 1236 on the sides 1212, 1214, 1216 and 1218 respectively are the low points. The kinks 1224, 1228, 1230 and 1234 on the sides 1212, 1214, 1216 and 1218 respectively are the high points. For the purposes of description, the kinks 1222, 1226, 1232 and 1236 are referred to as lower kinks; and the kinks 1224, 1228, 1230 and 1234 are referred to as upper kinks.

Figure 13:
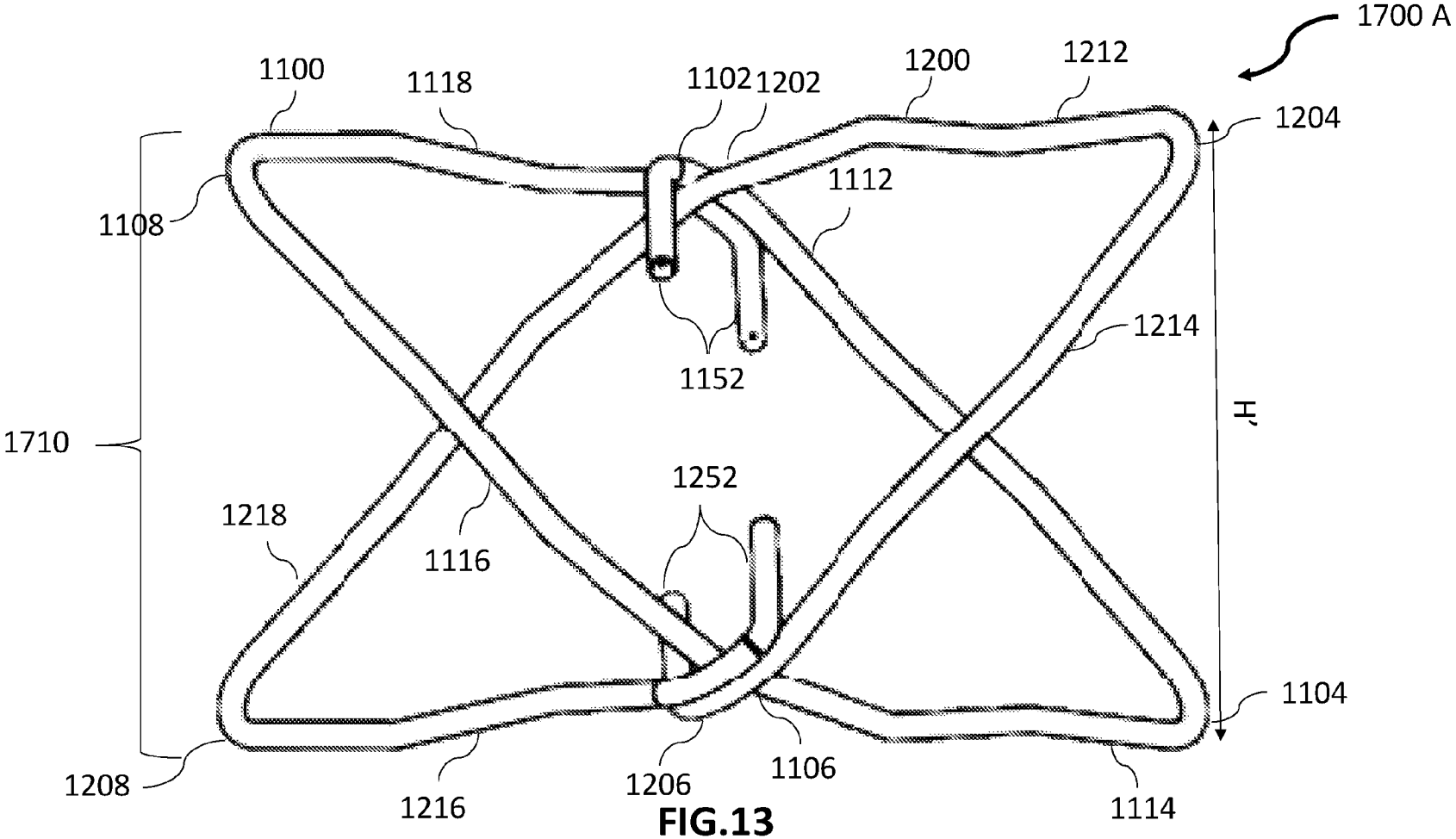
FIG. 13 illustrates a pair of mid-side kinked rhombical reinforcement ties of FIGS. 11 and 12 forming a reinforcement tie unit, in accordance with an exemplary embodiment of the present invention.

Referring to FIG. 13, illustrated is a pair of reinforcement ties 1100 and 1200 of FIGS. 11 and 12 respectively forming a reinforcement tie unit 1700A. For forming the reinforcement tie unit 1700A, the reinforcement ties 1100 and 1200 are disposed at mirror inclinations to each other, such that, the reinforcement ties cross each other at diametrically opposite corners of the other reinforcement ties.

As illustrated in FIG. 13, the reinforcement tie 1100 (first tie) crosses from inside of the reinforcement tie 1200 (second tie) at the respective corners 1106 and 1206, and the reinforcement tie 1200 crosses from inside of the reinforcement tie 1100 at the respective corners 1202 and 1102, configuring two non-intersecting crossings. In a first crossing, the corner 1106 of the reinforcement tie 1100 is on the inside and the corner 1206 of the reinforcement tie 1200 is on outside. In this configuration, the dual hook 1252 of the reinforcement tie 1200 engages the corner 1106 of the reinforcement tie 1100. In a second crossing, the corner 1202 of the reinforcement tie 1200 is on the inside and the corner 1102 of the reinforcement tie 1100 is on the outside. In this configuration, the dual hook 1152 of the reinforcement tie 1100 engages the corner 1202 of the reinforcement tie 1200.

Further, as illustrated in FIG. 13, the reinforcement ties 1100 and 1200 are at mirror inclinations to each other such that a distance (spacing) between corners of the rhombical ties 1100 and 1200 on the same structural bar is a predetermined height H'. Specifically, as illustrated in FIG. 13, H' is the distance between corners 1204 and 1104 of the reinforcement ties 1100 and 1200 respectively. Also, as illustrated, in this configuration, the reinforcement ties 1100 and 1200 form a sub interwoven network 1710.

Figure 14:
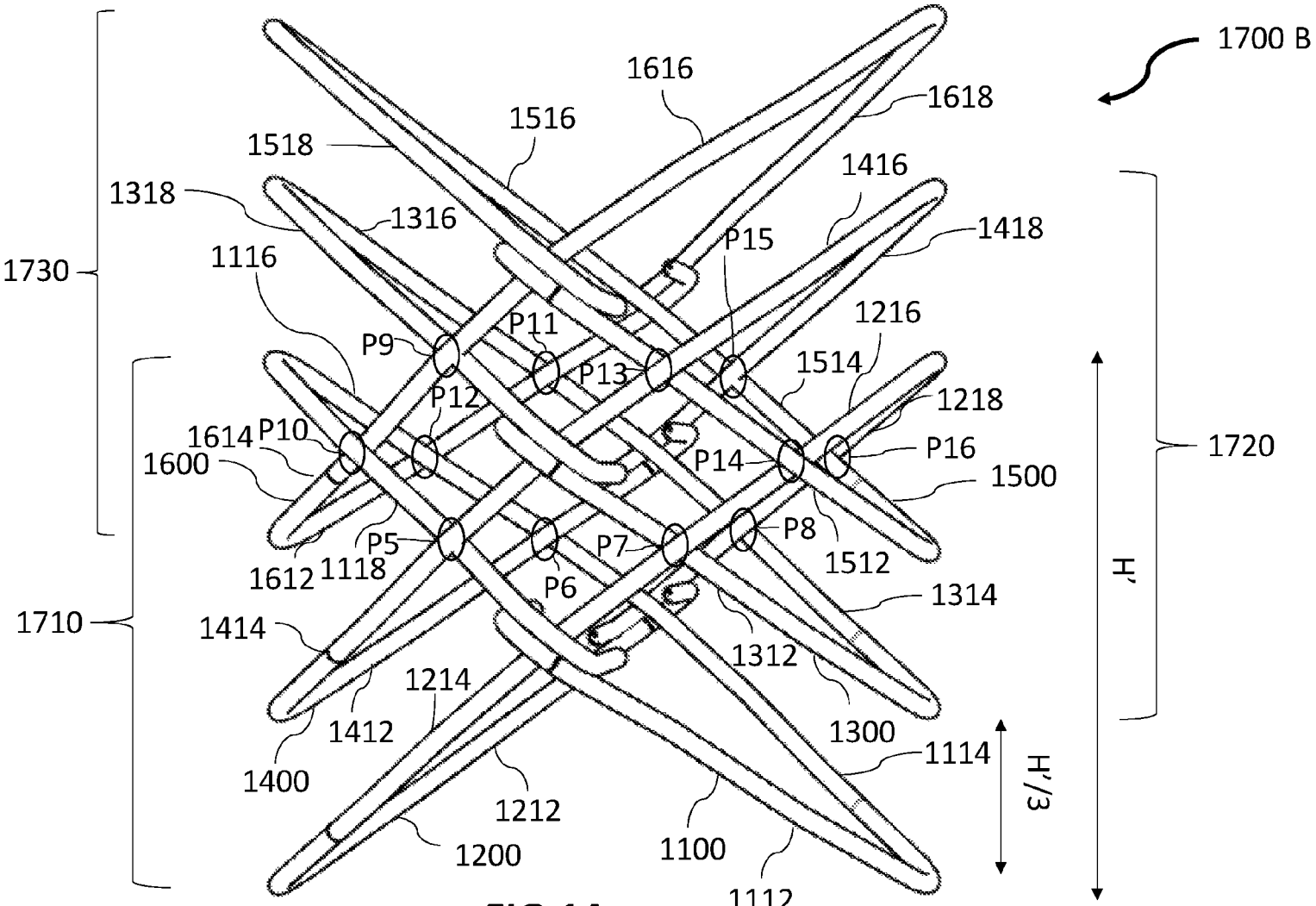
FIG. 14 illustrates three pairs of mid-side kinked rhombical reinforcement ties of FIGS. 11 and 12 forming multi-layered reinforcement tie unit, each pair having intersection with subsequent pair at one-third of the sides.

Now, referring to FIG. 14, illustrated are three pairs of one-third side kinked rhombical reinforcement ties of FIGS. 11, 12 forming a multi-layered reinforcement tie unit 1700B. Specifically, the multi-layered reinforcement tie unit 1700B comprises reinforcement ties 1100, 1200, 1300, 1400, 1500 and 1600. The one-third side kinked rhombical reinforcement ties 1300, 1400, 1500 and 1600 are similar to the reinforcement ties 1100 and 1200 as described with reference to FIGS. 13 and 14. The numbering of the hooks kinks and corners are not shown in FIG. 14 for clarity of the illustration of the three-dimensional network. Each pair intersects a subsequent pair at one-third of the sides of the reinforcement ties. The multi-layered reinforcement tie unit 1700B is only an unassembled representation (still not configured around the axially disposed structural bars) of the lateral reinforcement system of FIG. 14.

Specifically, the multi-layered reinforcement tie unit 1700B comprises of sub interwoven networks 1710, 1720 and 1730 (similar to the sub interwoven networks 1710 as described above in reference to FIG. 13). Specifically, the sub interwoven network 1720 is formed by reinforcement tie 1300 and the reinforcement tie 1400. The sub interwoven network 1730 is formed by the reinforcement tie 1500 and the reinforcement tie 1600.

For forming multi-layered reinforcement tie unit 1700B, these three-sub interwoven networks 1710, 1720 and 1730 are placed one above the other as shown in the FIG. 14 to form the multi-layered reinforcement tie unit 1700B. The three-sub interwoven networks 1710, 1720 and 1730 are placed one above the other in such a way such that the that the distance between the corners is approximately equal to H'/3. It will be evident to a person skilled in the art that the distance is not limited to H'/3 and can vary as per the configurational and reinforcement requirements.

Specifically, the sub interwoven network 1720 is placed above the sub interwoven network 1710 in such a way that the side 1414 of rhombical reinforcement tie 1400 crosses the side 1118 of the reinforcement tie 1100 at crossing point P5. The crossing at point P5 involves meeting of the upper kink of the side 1414 of reinforcement tie 1400 and lower kink of the side 1118 of reinforcement tie 1100. Further, the side 1412 of reinforcement tie 1400 crosses the side 1116 of the reinforcement tie 1100 at crossing point P6. The crossing at point P6 involves meeting of the lower kink of the side 1412 of reinforcement tie 1400 and upper kink of the side 1116 of reinforcement tie 1100.

The side 1312 of rhombical reinforcement tie 1300 crosses the side 1216 of the reinforcement tie 1200 at crossing point P7. The crossing at point P7 involves meeting of the upper kink of the side 1216 of rhombical tie 1200 and lower kink of the side 1312 of reinforcement tie 1300. Further, the side 1314 of reinforcement tie 1300 crosses the side 1218 of the reinforcement tie 1200 at crossing point P8. The crossing at point P8 involves meeting of the lower kink of the side 1218 of reinforcement tie 1200 and upper kink of the side 1314 of reinforcement tie 1300.

Similarly, the sub interwoven network 1730 is placed above the sub interwoven network 1720 in such a way that the side 1614 of reinforcement tie 1600 crosses the side 1318 of the reinforcement tie 1300 and side 1118 of the reinforcement tie 1100 at crossing point P9 and P10 respectively. The crossing at point P9 involves meeting of the upper kink of the side 1614 of reinforcement tie 1600 and lower kink of the side 1318 of reinforcement tie 1300. The crossing at point P10 involves meeting of the lower kink of the side 1614 of the reinforcement tie 1600 and upper kink of the side 1118 of the reinforcement tie 1100.

Further, the side 1612 of reinforcement tie 1600 crosses the side 1316 of the reinforcement tie 1300 and side 1116 of the reinforcement tie 1100 at crossing point P11 and P12 respectively. The crossing at point P11 involves meeting of the lower kink of the side 1612 of rhombical tie 1600 and upper kink of the side 1316 of the reinforcement tie 1300. The crossing at point P12 involves meeting of the upper kink of the side 1612 of reinforcement tie 1600 and lower kink of the side 1116 of the reinforcement tie 1100.

The side 1512 of reinforcement tie 1500 crosses the side 1416 of the reinforcement tie 1400 and the side 1216 of the reinforcement tie 1200 at crossing point P13 and P14 respectively. The crossing at point P13 involves meeting of the lower kink of the side 1512 of reinforcement tie 1500 and upper kink of the side 1416 of reinforcement tie 1400. The crossing at point P14 involves meeting of the upper kink of the side 1512 of reinforcement tie 1500 and lower kink of the side 1216 of reinforcement tie 1200.

Further, the side 1514 of reinforcement tie 1500 crosses the side 1418 of the reinforcement tie 1400 and side 1218 of the reinforcement tie 1200 at crossing point P15 and P16 respectively. The crossing at point P15 involves meeting of the upper kink of the side 1514 of reinforcement tie 1500 and lower kink of the side 1418 of reinforcement tie 1400. The crossing at point P16 involves meeting of the lower kink of the side 1514 of the reinforcement tie 1500 and upper kink of the side 1218 of reinforcement tie 1200.

It will be apparent, however, to one skilled in the art that the multi-layered reinforcement tie unit 1700B may contain one or more such sub interwoven networks placed one above the other in the similar pattern as described.

Figure 15:
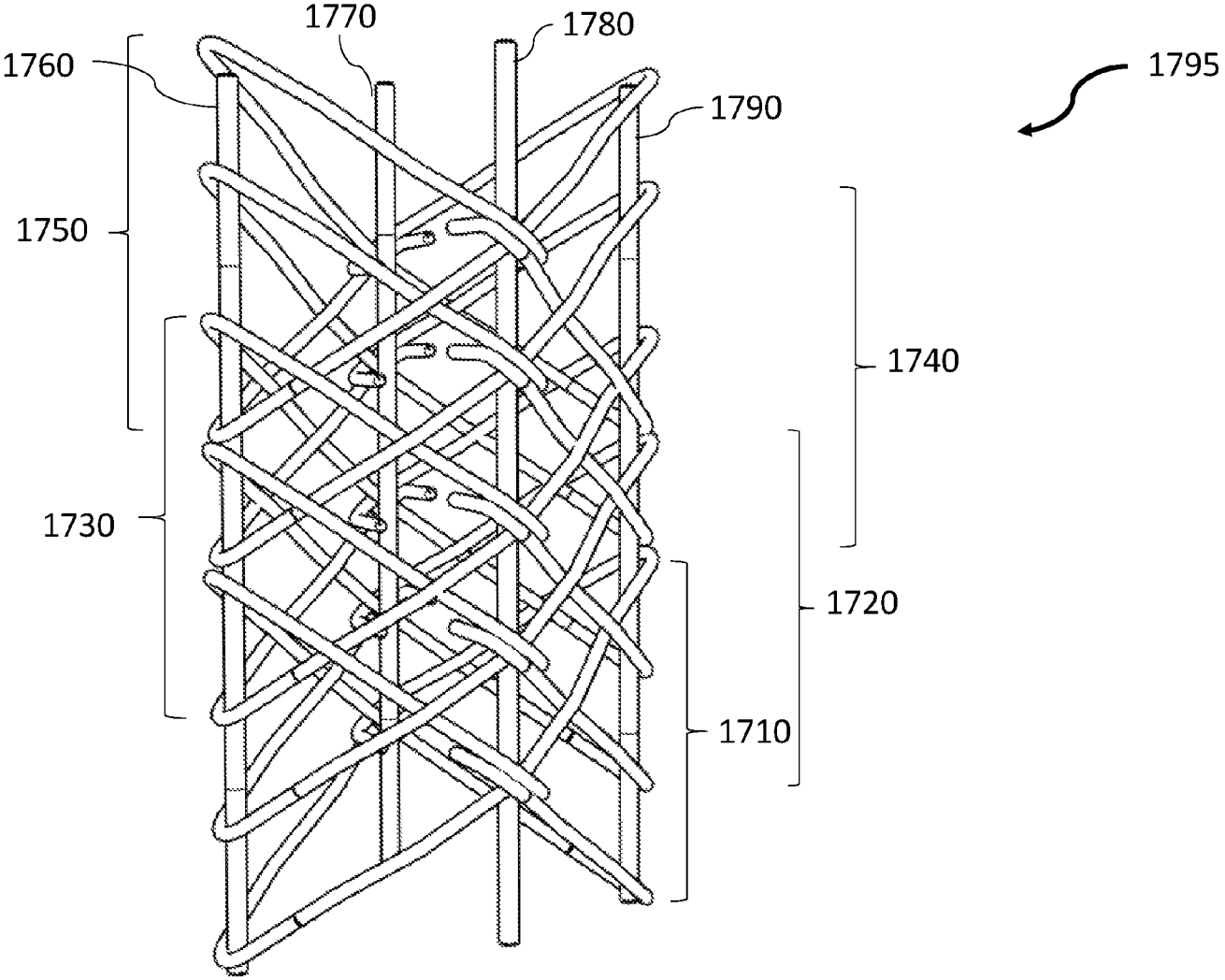
FIG. 15 illustrates a lateral reinforcement system comprising a plurality of one-third side kinked rhombical reinforcement ties of FIGS. 11 and 12 forming multi-layered reinforcement tie unit (as in FIG. 14) and consequently a three-dimensional interwoven network around a plurality of axially disposed structural bars.

Now, referring to FIG. 15, illustrated is a lateral reinforcement system 1795 (assembled form) comprising a plurality comprising a plurality of one-third side kinked rhombical reinforcement ties of FIGS. 11, 12 forming a three-dimensional interwoven network around a plurality of axially disposed structural bars 1760, 1770, 1780 and 1790. In the lateral reinforcement system 1795, reinforcement ties (not labeled) are disposed at an inclination to the axially disposed structural bars 1760, 1770, 1780 and 1790. That is, the reinforcement ties (not labeled) are disposed at an angle to the axially disposed structural bars 1760, 1770, 1780 and 1790 making it also inclined at an angle to a surface on which the axially disposed structural bars 1760, 1770, 1780 and 1790 are disposed.

In this configuration, the reinforcement ties in a pair of reinforcement ties cross each at diametrically opposite corners of the reinforcement ties at diametrically opposite structural bars, such that, a first reinforcement tie of the pair of reinforcement ties crosses from inside of a second reinforcement tie of the pair of reinforcement ties at one structural bar, and the second reinforcement tie crosses from inside of the first one-third side kinked rhombical reinforcement tie at the diametrically opposite structural bar.

Further, this configuration comprises placing a first one-third side kinked reinforcement tie unit and then second one-third side kinked reinforcement tie unit on top of the first reinforcement tie unit, such that the kinks present in the lower half part of the second one-third side kinked reinforcement tie unit crosses the kinks present in the upper half part of the first one-third side kinked reinforcement tie unit and thereafter placing the third one-third side kinked reinforcement tie unit, such that the kinks present in the lower half part of the third one-third side kinked reinforcement tie unit crosses the kinks present in the upper half part of the second one-third side kinked reinforcement tie and further crosses the kinks present upper half part of the first one-third side kinked reinforcement tie unit and so on.

In this formation, the plurality of the one-third side kinked rhombical reinforcement ties form a three-dimensional interwoven network around the axially disposed structural bars 1760, 1770, 1780 and 1790. The three-dimension interwoven network is a collection of sub-interwoven networks formed by individual mid-side kinked reinforcement tie units. For example, as illustrated in FIG. 15, a first sub-interwoven network 1710 is formed by the first one-third side kinked reinforcement tie unit, and a second sub-interwoven network 1720 is formed by the second one-third side kinked reinforcement tie unit.

It will be apparent, however, to one skilled in the art that the lateral reinforcement system 1700B (assembled form) may contain one or more such sub interwoven networks placed one above the other in the similar pattern as described above to get the lateral reinforcement system 1700B (assembled form). Such pattern is shown in FIG. 15 comprising sub-interwoven networks 1710, 1720, 1730, 1740 and 1750.

Figure 16:
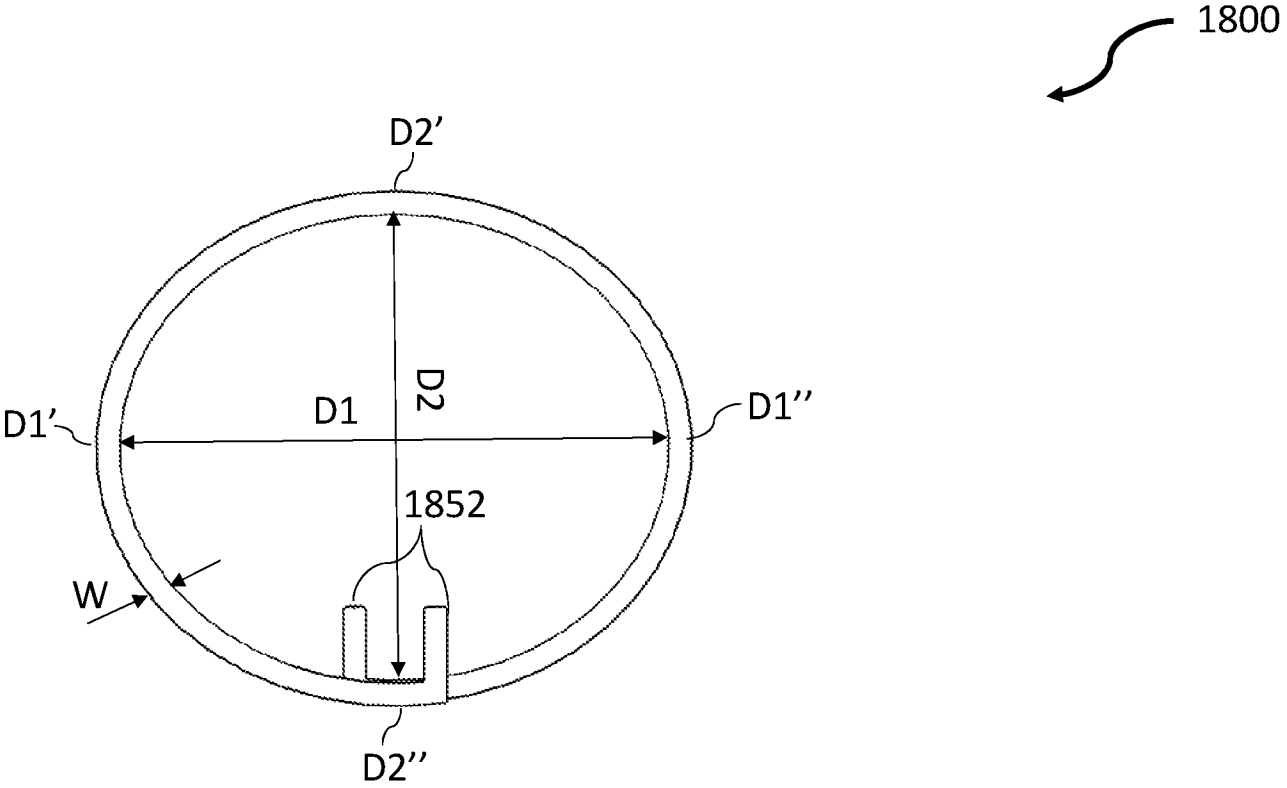
FIG. 16 illustrates an elliptical reinforcement tie, in accordance with an exemplary embodiment of the present invention.

FIG. 16 illustrates an elliptical reinforcement tie 1800, in accordance with another exemplary embodiment of the present invention. As used herein, "elliptical reinforcement tie" refers to a reinforcement tie in shape of an ellipse or oval (or any circular shape as per the shape of vertical member/horizontal member). The reinforcement tie 1800 is made of solid steel bar (or any other metallic/non-metallic bar) having a circular cross section of diameter W having major diameter D1 and minor diameter D2. The diameter D1 comprises two ends D1' and D1"and the diameter D2 comprises two ends D2' and D2". It will be evident to a person skilled in the art that the dimension nomenclature W is only for illustration and description purposes and the invention is not limited by such dimension nomenclature.

Further, the reinforcement tie 1800 comprises a dual hook member 1852 disposed at one of the end of the reinforcement tie 1800. As shown in FIG. 16, the dual hook member 1852 is disposed at the end D2" of the reinforcement tie 1800 as shown in FIG. 16. The dual hook member 1852 provides for anchoring the reinforcement tie 1800 to the load bearing element of the structural bars. Further, the dual hook member 1852 provides for engaging an end of another elliptical reinforcement tie.

Figure 17A:
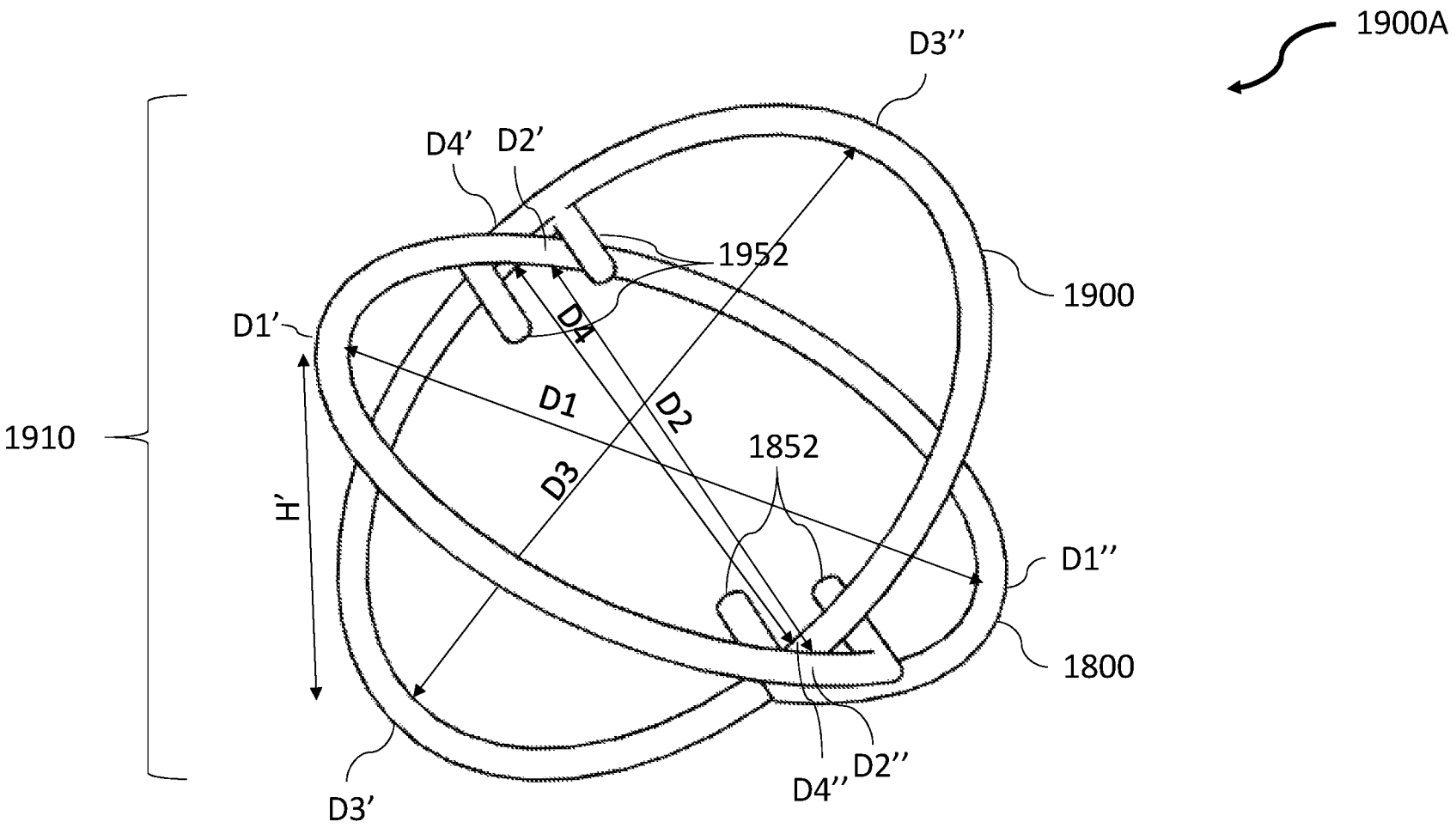
FIG. 17A illustrates a pair of elliptical reinforcement ties of FIG. 16 forming a reinforcement tie unit, in accordance with an exemplary embodiment of the present invention.

Referring to FIG. 17A, illustrated is a pair of elliptical reinforcement ties of FIG. 16 forming a reinforcement tie unit 1900A. In FIG. 17A, the elliptical reinforcement ties are a first elliptical reinforcement tie 1800 and a second elliptical reinforcement tie 1900. The second elliptical reinforcement tie 1900 is similar to the first elliptical reinforcement tie 1800 in shape and dimension, as described with reference to FIG. 16. Specifically, the second elliptical reinforcement tie 1900 is made of solid steel bar (or any other metallic/non-metallic bar) having a circular cross section of diameter W having major diameter D3 and minor diameter D4. The diameter D3 comprises two ends D3' and D3" and the diameter D4 comprises two ends D4' and D4". Further, the reinforcement tie 1900 comprises a dual hook member 1952 disposed at one of the end of the reinforcement tie 1900. As shown in FIG. 17A, the dual hook member 1952 is disposed at the end D4' of the elliptical tie 1900 as shown in FIG. 17A.

For forming the reinforcement tie unit 1900A, the reinforcement ties 1800, 1900 are disposed at mirror inclinations to each other, such that, the reinforcement ties are rotated about minor diameters D2, D4 and cross each other at diametrically opposite ends of the elliptical reinforcement ties, thereby configuring two non-intersecting crossings.

In a first crossing, the first elliptical reinforcement tie 1800 crosses from inside of the second elliptical reinforcement tie 1900. Specifically, the end D2' of the first reinforcement tie 1800 is on the inside and the end D4' of the second reinforcement tie 1900 is on outside. In this configuration, the dual hook 1952 of the second reinforcement tie 1900 engages the end D2' of the first reinforcement tie 1800.

In a second crossing, the second elliptical reinforcement tie 1900 crosses from inside of the first elliptical reinforcement tie 1800. Specifically, the end D4" of the second reinforcement tie 1900 is on the inside and the end D2" of the first reinforcement tie 1800 is on outside. In this configuration, the dual hook 1852 of the first reinforcement tie 1800 engages the end D4" of the second reinforcement tie 1900. Further, as illustrated in FIG. 17A the inclination of reinforcement tie 1900 and reinforcement tie 1800 with reference to the base is H'. Also, as illustrated, in this configuration, the reinforcement ties 1800, 1900 form a sub interwoven network 1910.

Figure 17B:
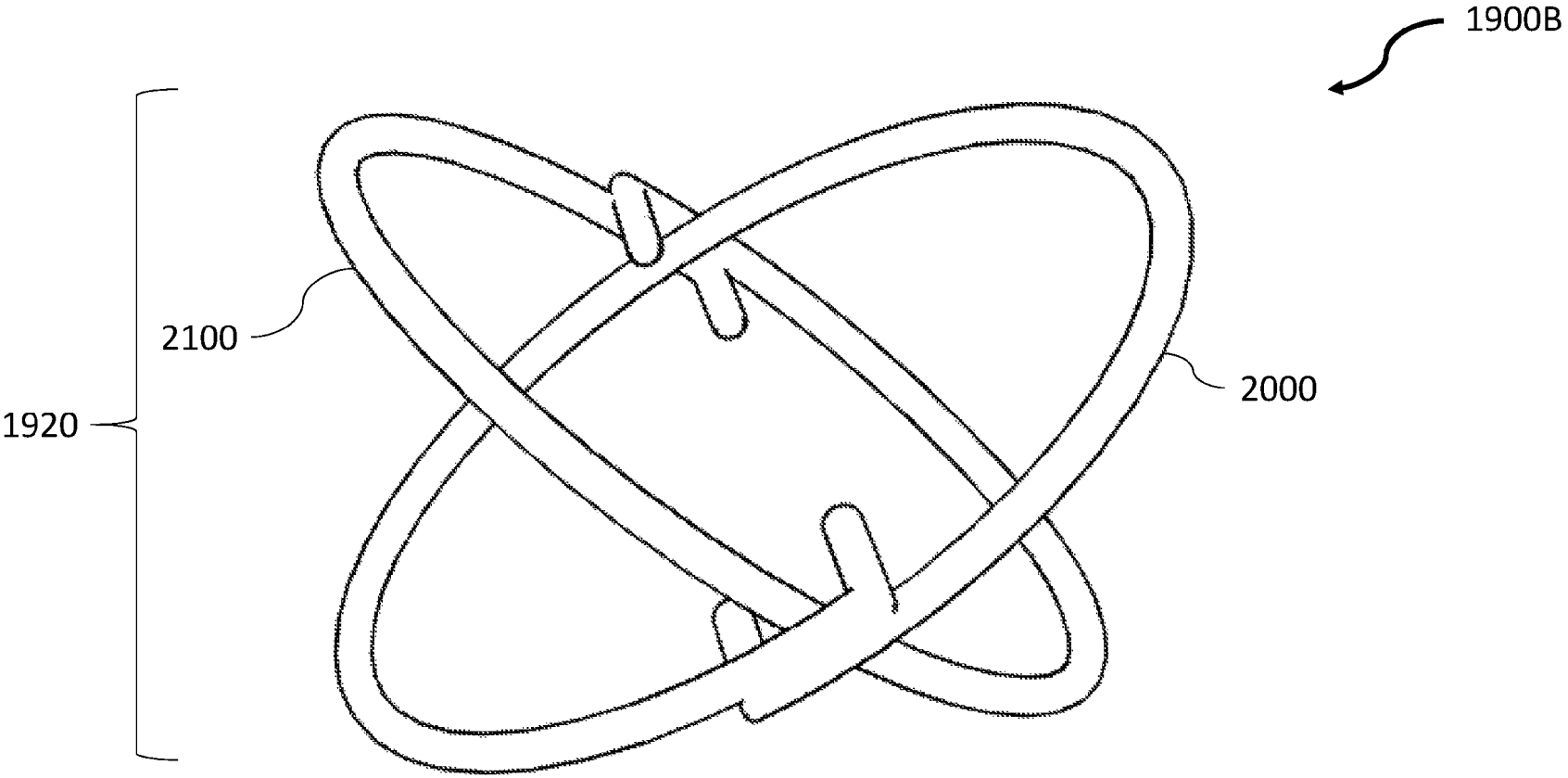
FIG. 17B illustrates a pair of elliptical reinforcement ties of FIG. 16 forming a reinforcement tie unit mirror image to the reinforcement tie unit of FIG. 17A, in accordance with an exemplary embodiment of the present invention.

Similarly, referring to FIG. 17B, illustrated is a pair of elliptical reinforcement ties of FIG. 16 forming a reinforcement tie unit 1900B. A sub interwoven network 1920 as illustrated in FIG. 17B is the mirrored structure of the sub interwoven network 1910 as illustrated in FIG. 17A. The sub interwoven network 1920 is formed by the elliptical reinforcement tie 2000 and elliptical reinforcement tie 2100. Specifically, the sub interwoven network 1920 is rotated version of the sub interwoven network 1910, which is rotated by 180 degree.

Figure 18:
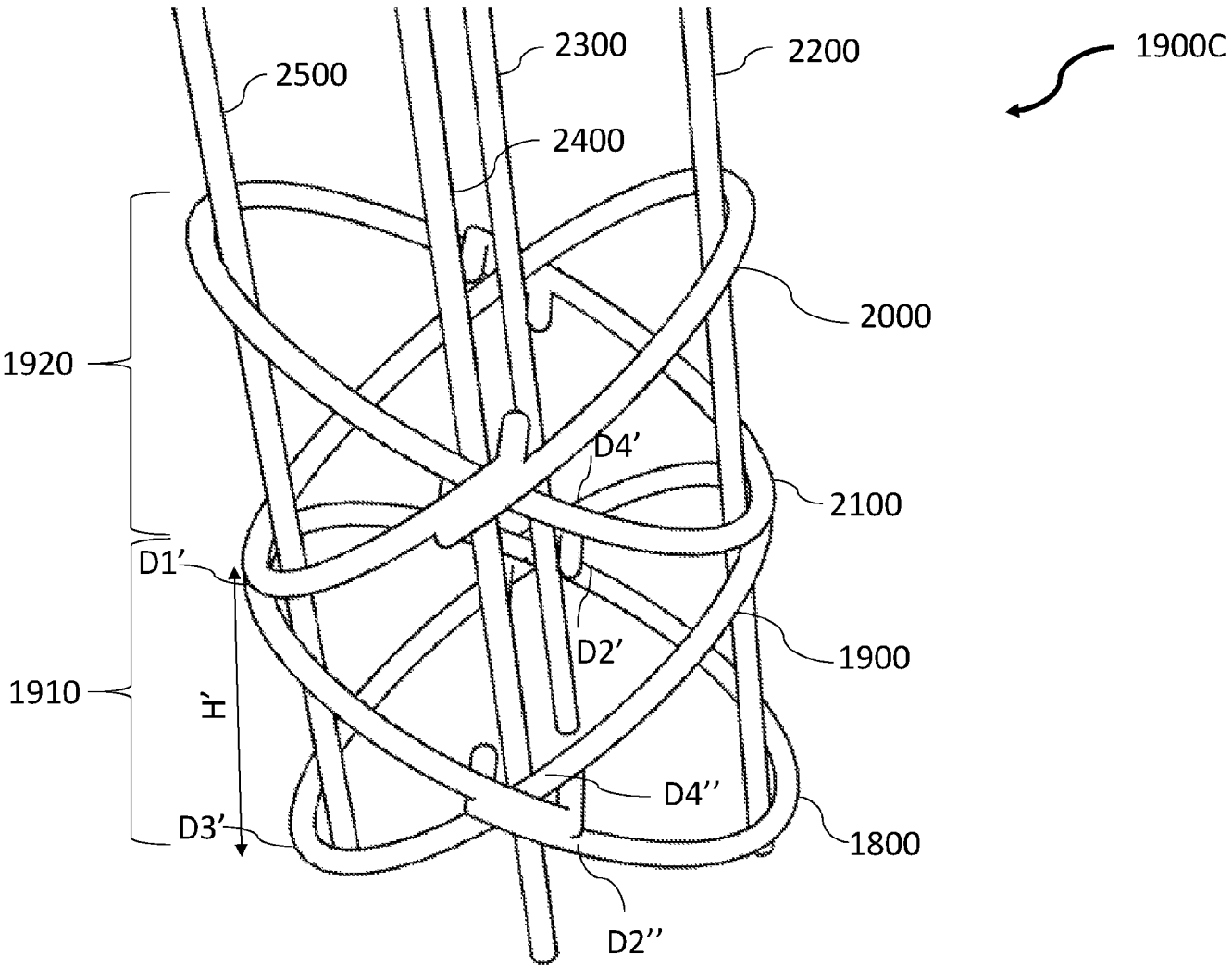
FIG. 18 illustrates a lateral reinforcement system comprising a plurality of elliptical reinforcement ties of FIG. 16 forming a three-dimensional interwoven network around a plurality of axially disposed structural bars.

Now, referring to FIG. 18, illustrated is a lateral reinforcement system 1900C comprising a plurality of elliptical reinforcement ties of FIG. 16 forming a three-dimensional interwoven network around a plurality of axially disposed structural bars 2200, 2300, 2400 and 2500. In the lateral reinforcement system 1900C, the elliptical reinforcement ties 1800, 1900, 2000 and 2100 are disposed at an inclination to the axially disposed structural bars 2200, 2300, 2400 and 2500. That is, the reinforcement ties 1800, 1900, 2000 and 2100 are disposed at an angle to the axially disposed structural bars 2200, 2300, 2400 and 2500 making it also inclined at an angle to a surface on which the axially disposed structural bars 2200, 2300, 2400 and 2500 are disposed.

In this configuration, the reinforcement ties in a pair of reinforcement ties cross each at diametrically opposite ends of the reinforcement ties at diametrically opposite structural bars, such that, a first reinforcement tie of the pair of reinforcement ties crosses from inside of a second reinforcement tie of the pair of reinforcement ties at one structural bar, and the second reinforcement tie crosses from inside of the first reinforcement tie at the diametrically opposite structural bar. For example, in a first crossing, the reinforcement tie 1800 (first reinforcement tie) crosses from inside of the reinforcement tie 1900 (second reinforcement tie) at the structural bar 2300. In this crossing, the end D2' of the reinforcement tie 1800 is on the inside and the end D4' of the reinforcement tie 1900 is on outside. Further, in a second crossing, the reinforcement tie 1900 (second reinforcement tie) crosses from inside of the reinforcement tie 1800 (first reinforcement tie) at diametrically opposite structural bar 2400. In this crossing, the end D4" of the second reinforcement tie 1900 is on the inside and the corner D2' of the first reinforcement tie 1800 is on outside. Accordingly, the pair of reinforcement ties 1800 and 1900 is configured to form two non-intersecting crossings at the diametrically opposite structural bars 2300 and 2400.

The pair of elliptical reinforcement ties 2000 and 2100 is configured in a similar manner.

For forming the lateral reinforcement system 1900C, a plurality of reinforcement tie units (such as the reinforcement tie unit 1900A and 1900B) are disposed on and the about the axially disposed structural bars 2200, 2300, 2400 and 2500. The process comprises placing a first reinforcement tie unit and then another reinforcement tie unit on top of the first reinforcement tie unit, and so on. For example, the first reinforcement tie unit (herein referred to as reinforcement tie unit 1900A) is formed by reinforcement ties 1800 and 1900 configured about each other and about the axially disposed structural bars 2200, 2300, 2400 and 2500 as explained above. Next, a second reinforcement tie unit is formed by reinforcement ties 2000 and 2100 and is placed over the first reinforcement tie unit 2000.

In this formation, the plurality of elliptical reinforcement ties 1800, 1900, 2000 and 2100 form a three-dimensional interwoven network around the axially disposed structural bars 2200, 2300, 2400 and 2500. The three-dimension interwoven network is a collection of sub-interwoven networks formed by individual reinforcement tie units. For example, as illustrated in FIG. 18, a first sub-interwoven network 1910 is formed by the first reinforcement tie unit 1900A, and a second sub-interwoven network 1920 is formed by the second reinforcement tie unit 1900B. Although, in FIG. 18 herein, illustrated are only two reinforcement tie units forming two sub-interwoven networks, it will be evident to a person skilled in the art that the lateral reinforcement system can comprise more than two sub-interwoven networks as per the shape and size requirements of the structural bars and reinforcement requirement for a concrete structure.

Further, as illustrated in FIG. 18, the reinforcement ties 1800, 1900 are at mirror inclinations to each other such that a distance (spacing) between ends of the elliptical ties 1800, 1900 on the same structural bar is a pre-determined height H". Specifically, as illustrated in FIG. 18, H" is the distance between end D1' of the reinforcement tie 1800 and corner D3' of the reinforcement tie 1900 on the structural bar 2500.

Figure 19A:
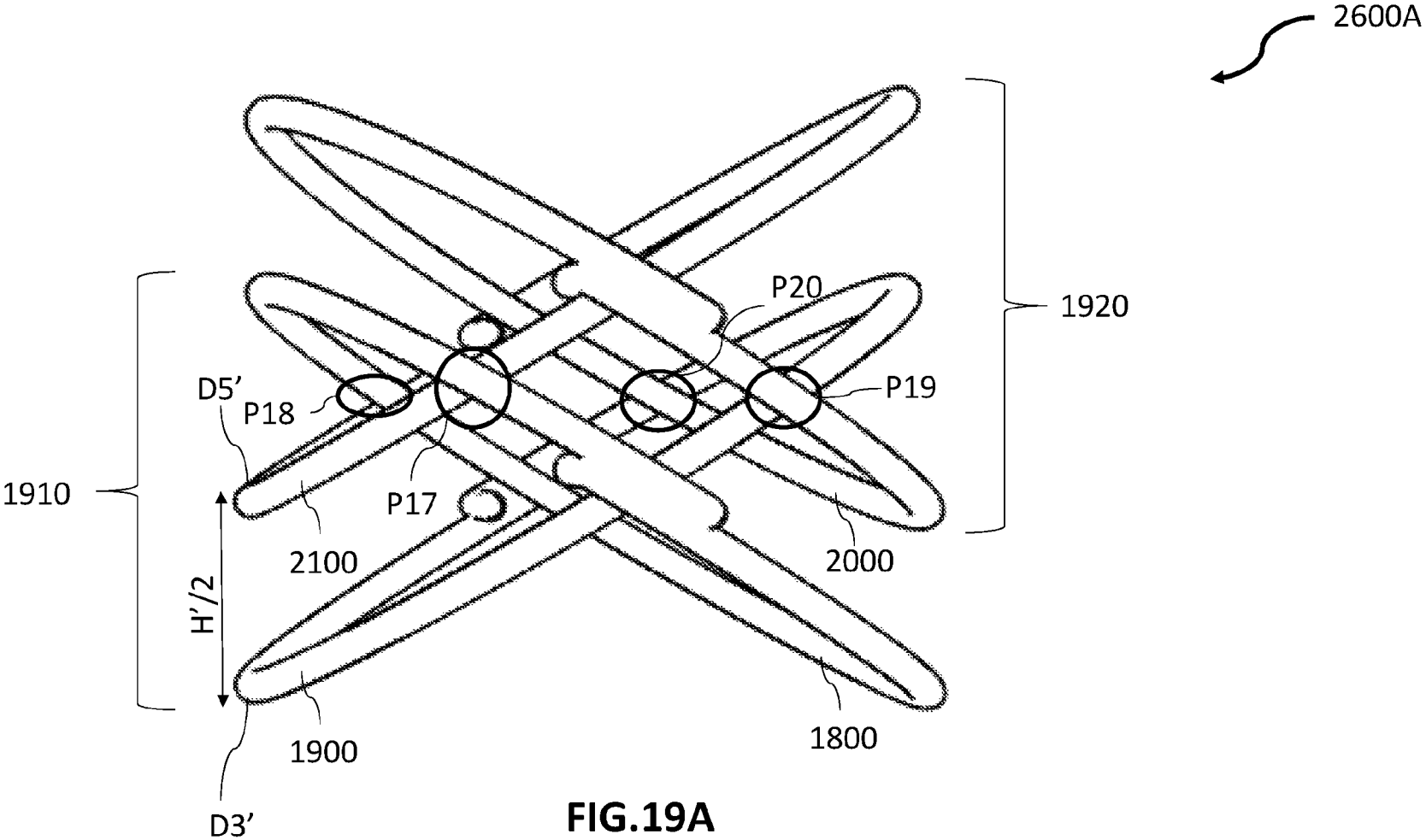
FIG. 19A illustrates two pairs of elliptical reinforcement ties of FIG. 16 forming a multi-layered reinforcement tie unit 2600A.

Now, referring to FIG. 19A, illustrated are two pairs of elliptical reinforcement ties of FIG. 16 forming a multi-layered reinforcement tie unit 2600A. The multi-layered reinforcement tie unit is only an unassembled representation (still not configured around the axially disposed structural bars) of the lateral reinforcement system 2600B of FIG. 19B.

For forming the multi-layered reinforcement tie unit 2600A, two-sub interwoven networks 1910 and 1920 are placed one above the other as shown in the FIG. 19A. The two-sub interwoven networks 1910 and 1920 are placed one above the other in such a way such that the distance between the end D5' of reinforcement tie 2100 and end D3' of tie 1900 is approximately equal to H'/2. It will be evident to a person skilled in the art that the distance is not limited to H'/2 and can vary as per the configurational and reinforcement requirements.

Specifically, the reinforcement tie 2100 crosses the reinforcement tie 1800 at crossing points P17 and P18 on the periphery at one third of the diameter along the major axis of the elliptical reinforcement tie 1800. Further, the reinforcement tie 2000 crosses the reinforcement tie 1900 at crossing points P19 and P20 on the periphery at one third of the diameter along the major axis of the elliptical reinforcement tie 1900.

It will be apparent, however, to one skilled in the art that the multi-layered reinforcement tie unit 2600A may contain one or more such sub interwoven networks placed one above the other in the similar pattern as described.

Figure 19B:
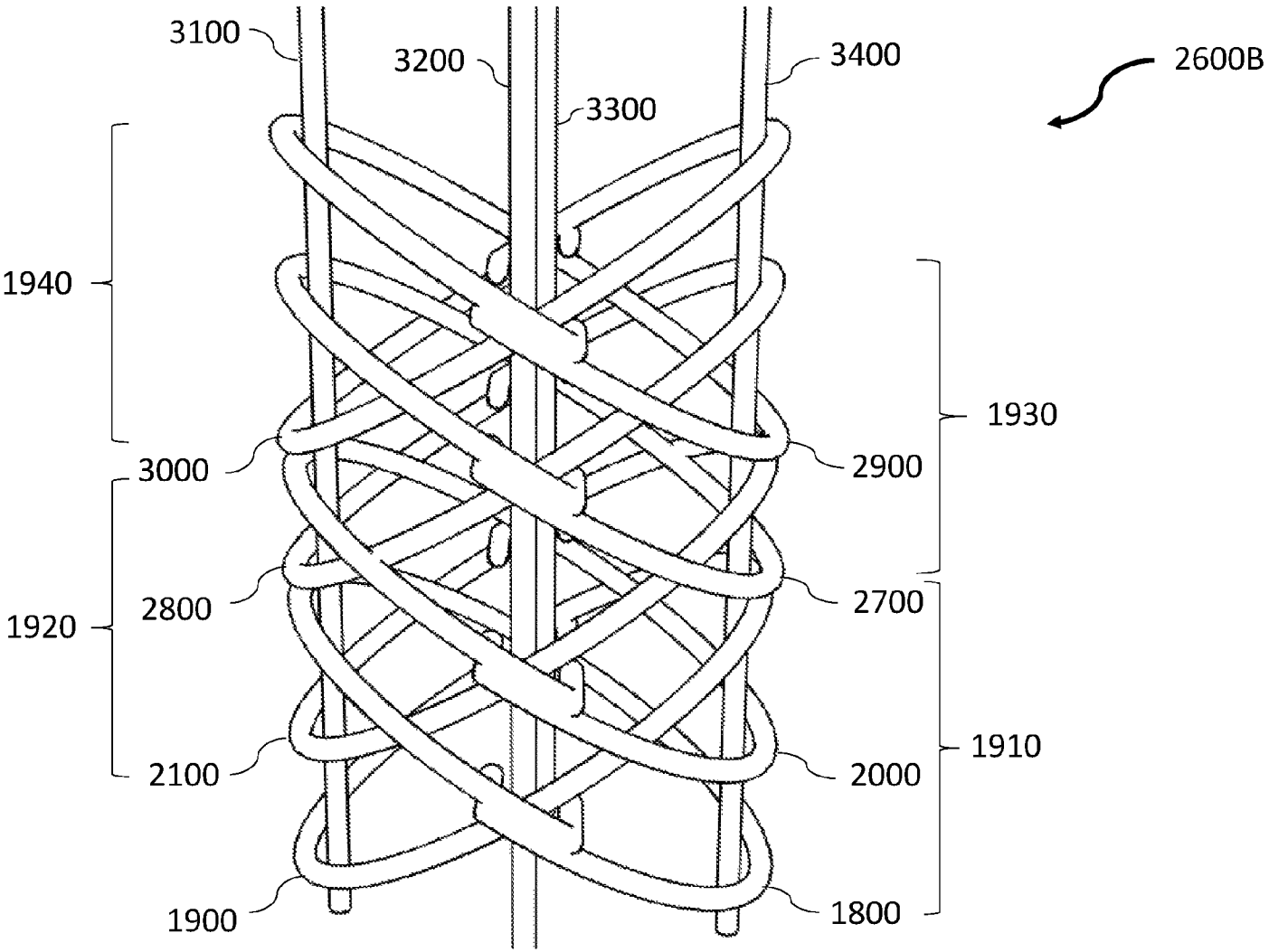
FIG. 19B illustrates a lateral reinforcement system comprising a plurality of elliptical reinforcement ties of FIG. 16 forming a three-dimensional interwoven network around a plurality of axially disposed structural bars.

Now, referring to FIG. 19B, illustrated is a lateral reinforcement system 2600B (assembled form) comprising a plurality of elliptical reinforcement ties of FIG. 16 forming a three-dimensional interwoven network around a plurality of axially disposed structural bars 3100, 3200, 3300 and 3400. In the lateral reinforcement system 2600B, reinforcement ties 1800, 1900, 2000, 2100, 2700, 2800, 2900 and 3000 are disposed at an inclination to the axially disposed structural bars 3100, 3200, 3300 and 3400. That is, the reinforcement ties 1800, 1900, 2000, 2100, 2700, 2800, 2900 and 3000 are disposed at an angle to the axially disposed structural bars 3100, 3200, 3300 and 3400 making it also inclined at an angle to a surface on which the axially disposed structural bars 3100, 3200, 3300 and 3400 are disposed. The reinforcement ties 2700, 2800, 2900 and 3000 are similar to the reinforcement ties 1800, 1900, 2000 and 2100 as described above.

In this configuration, the reinforcement ties in a pair of reinforcement ties cross each other at minor diameters at diametrically opposite structural bars, such that, a first reinforcement tie of the pair of reinforcement ties crosses from inside of a second reinforcement tie of the pair of reinforcement ties at one structural bar, and the second reinforcement tie crosses from outside of the first reinforcement tie at the diametrically opposite structural bar.

For example, in a first crossing of the pair of reinforcement ties 1800 and 1900, reinforcement tie 1800 (first reinforcement tie) crosses from inside of the reinforcement tie 1900 (second reinforcement tie) at the structural bar 3300. Further, in a second crossing, the reinforcement tie 1900 (second reinforcement tie) crosses from inside of the reinforcement tie 1800 (first reinforcement tie) at diametrically opposite structural bar 3200. Accordingly, the pair of reinforcement ties 1800, 1900 is configured to form two non-intersecting crossings at the diametrically opposite structural bars 3300 and 3200. Similarly, the pair of reinforcement ties 2000, 2100 is configured to form two non-intersecting crossings at the diametrically opposite structural bars 3300 and 3200. Also, the pair of reinforcement ties 2700, 2800, 2900 and 3000 is configured to form two non-intersecting crossings at the diametrically opposite structural bars 3300 and 3200.

For forming the lateral reinforcement system 2600B, a plurality of elliptical reinforcement tie units (such as the elliptical reinforcement tie units 1800, 1900, 2000, 2100, 2700, 2800, 2900 and 3000) are disposed on and the about the axially disposed structural bars 3100, 3200, 3300 and 3400. The process comprises placing a first elliptical reinforcement tie unit and then second elliptical reinforcement tie unit on top of the first reinforcement tie unit, such that the crossing of the ties present in the lower half part of the second elliptical reinforcement tie unit crosses the ties present in the upper half part of the first elliptical reinforcement tie unit at the periphery at one third of the diameter along the major axis and so on.

In this formation, the plurality of the elliptical reinforcement ties 1800, 1900, 2000, 2100, 2700, 2800, 2900 and 3000 form a three-dimensional interwoven network around the axially disposed structural bars 3100, 3200, 3300 and 3400. The three-dimensional interwoven network is a collection of sub-interwoven networks 1910, 1920, 1930 and 1940 formed by combining individual elliptical reinforcement tie units.

Now, a further embodiment of the present invention is described herein with reference to FIGS. 20, 21, 22A and 22B.

Figure 20:
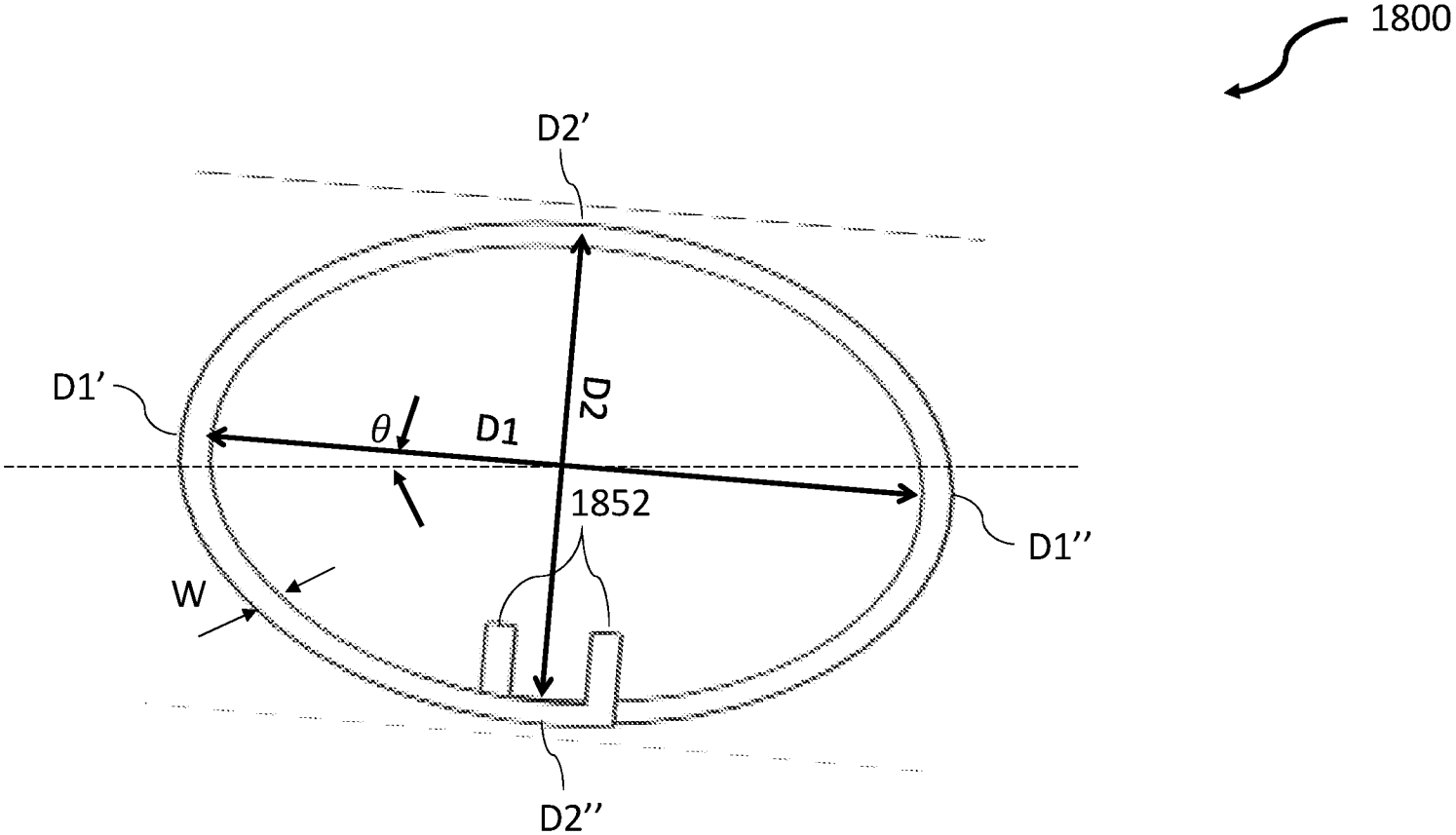
FIG. 20 illustrates an elliptical reinforcement tie similar to the reinforcement tie of FIG. 16 and rotated clockwise by a pre-determined angle, in accordance with an exemplary embodiment of the present invention.
Figure 21:
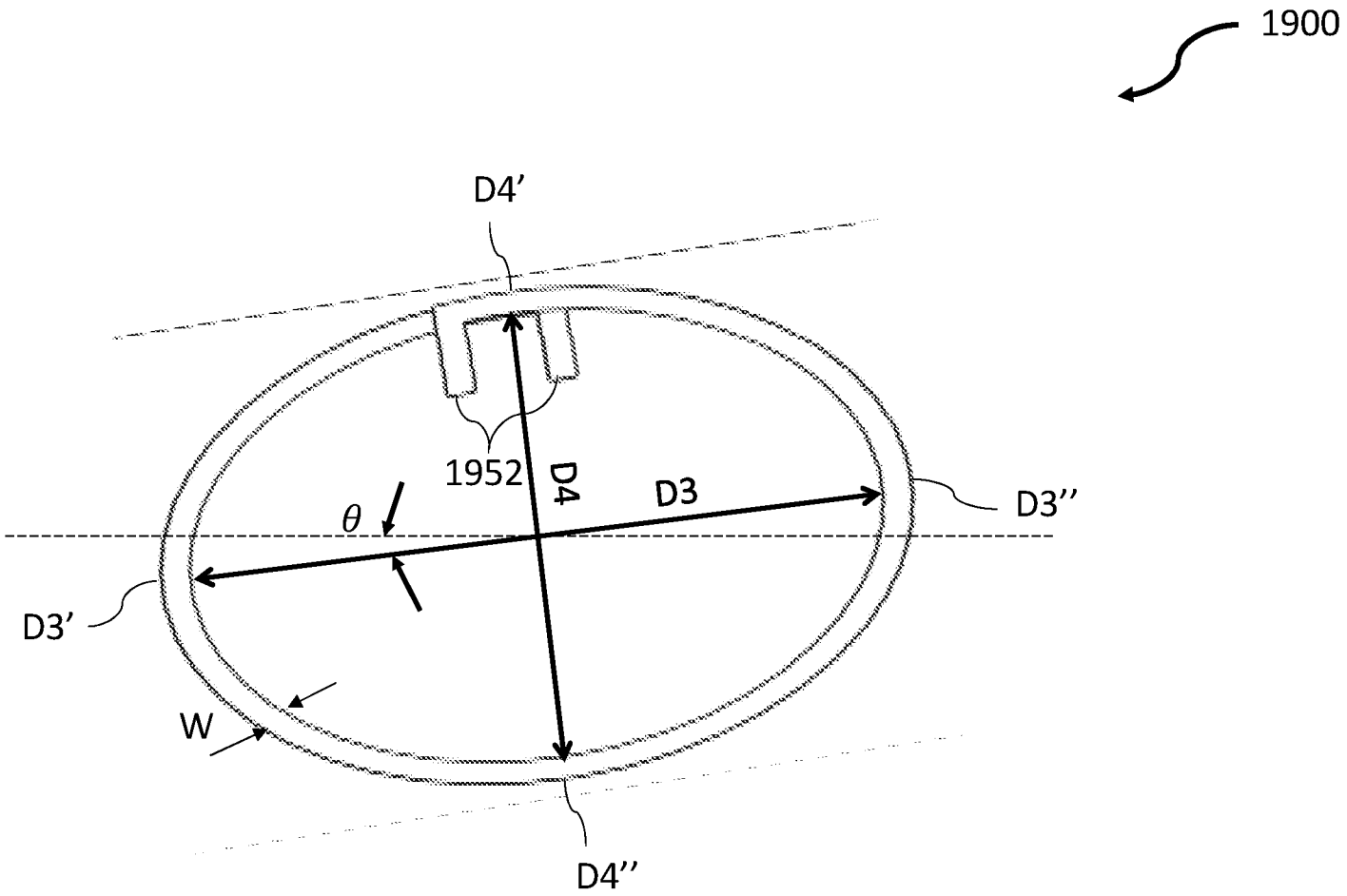
FIG. 21 illustrates an elliptical reinforcement tie that is a mirror image of the reinforcement tie of FIG. 20 and rotated counter-clockwise by the pre-determined angle, in accordance with an exemplary embodiment of the present invention.

Referring to FIG. 20, illustrated is an elliptical reinforcement tie similar to the reinforcement tie of FIG. 16 and rotated clockwise by a pre-determined angle. Referring to FIG. 21, illustrated is an elliptical reinforcement tie that is a mirror image of the reinforcement tie of FIG. 20 and rotated counter-clockwise by the pre-determined angle. Herein, the pre-determined angle is represented by θ.

Figure 22A:
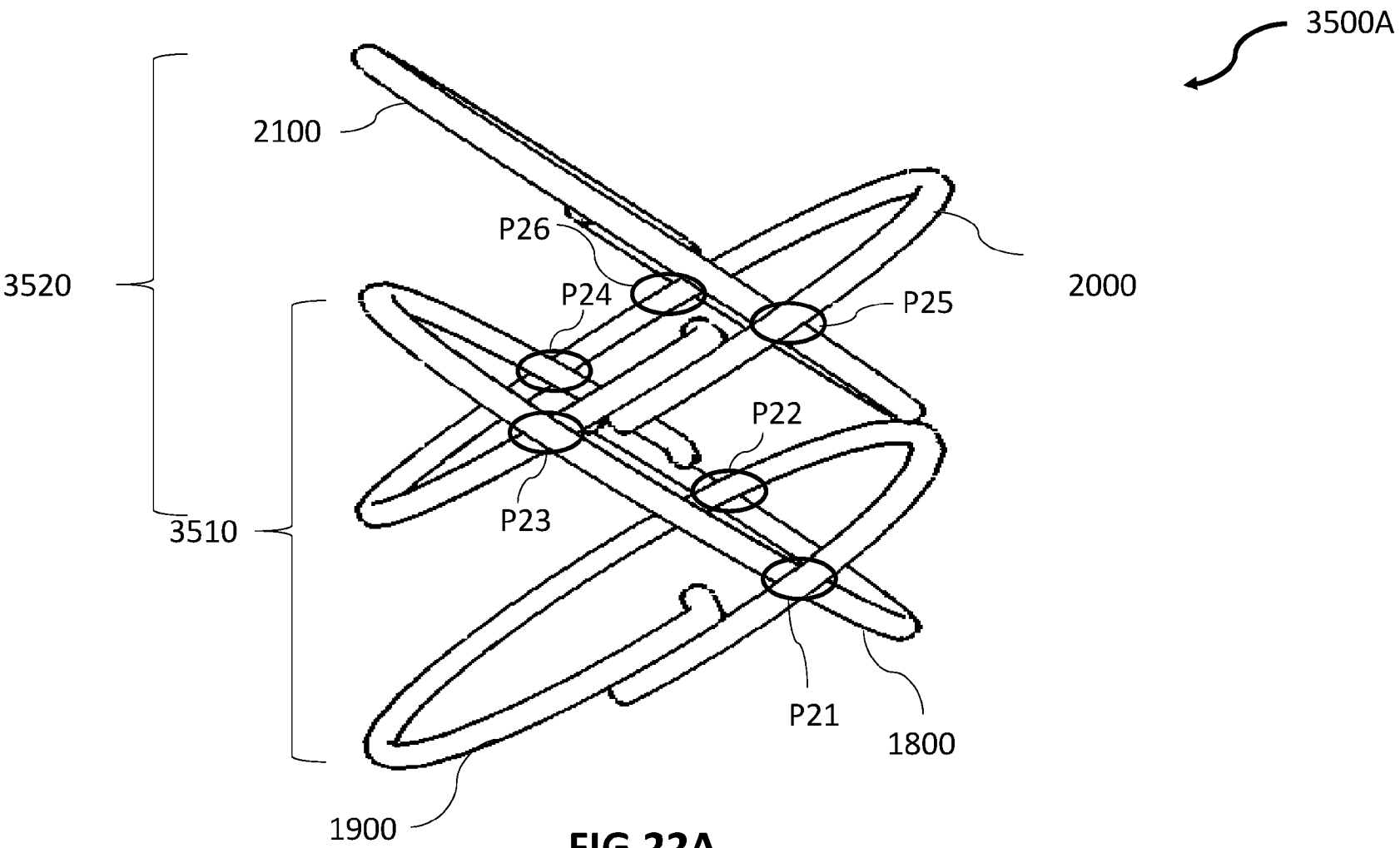
FIG. 22A illustrates two pairs of elliptical reinforcement ties of FIGS. 20 and 21 forming a multi-layered reinforcement tie unit 3500A.

Now, referring to FIG. 22A, illustrated are two pairs of elliptical reinforcement ties of FIGS. 20 and 21 forming a multi-layered reinforcement tie unit 3500A. Specifically, the first pair comprises of the elliptical reinforcement ties 1800 and 1900 as illustrated in FIG. 20 and FIG. 21 respectively and the second pair comprises of elliptical reinforcement ties 2000 and 2100. The elliptical reinforcement ties 2000 and 2100 is also similar to the elliptical ties as illustrated in FIG. 17B. In this configuration, the elliptical reinforcement ties 2000 and 2100 are rotated clockwise and anticlockwise respectively by pre-determined angle θ.

Figure 22B:
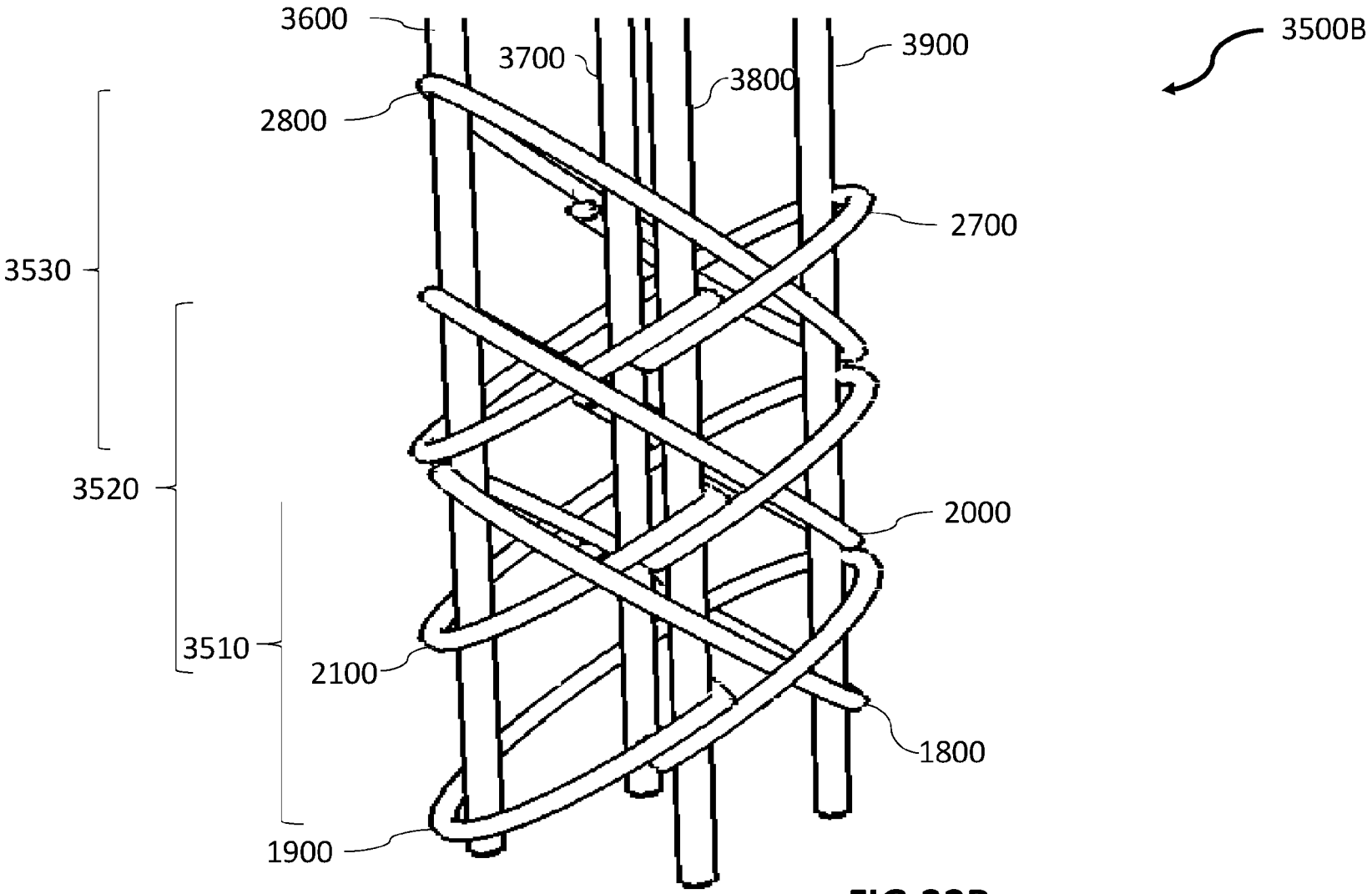
FIG. 22B illustrates is a lateral reinforcement system comprising a plurality of elliptical reinforcement ties of FIGS. 20 and 21 forming a three-dimensional interwoven network around a plurality of axially disposed structural bars.

The multi-layered reinforcement tie unit 3500A is only an unassembled representation (still not configured around the axially disposed structural bars) of the lateral reinforcement system 3500B of FIG. 22B.

For forming the multi-layered reinforcement tie unit 3500A, two-sub interwoven networks 3510 and 3520 are placed one above the other as shown in the FIG. 22A.

Specifically, the reinforcement tie 2000 crosses the reinforcement tie 2100 at crossing points P25 and P26 and further crosses the reinforcement tie 1800 at crossing points P23 and P24. The crossing points are on the periphery at one third of the diameter along the major axis of the elliptical reinforcement ties. Specifically, at crossing point P25, the reinforcement tie 2000 crosses from outside the reinforcement tie 2100 and at crossing point P26 the reinforcement tie 2000 crosses from inside the reinforcement tie 2100. Further, at crossing point P23, the reinforcement tie 2000 crosses from inside the reinforcement tie 1800; and at crossing point P24, the reinforcement tie 2000 crosses from outside the reinforcement tie 1800. Similarly, the reinforcement tie 1800 crosses the reinforcement tie 1900 at the crossing points P21 and P22. At the crossing point P21, the reinforcement tie 1800 crosses from inside the reinforcement tie 1900 and at the crossing point P22 the reinforcement tie 1800 crosses from outside the reinforcement tie 1900.

It will be apparent, however, to one skilled in the art that the multi-layered reinforcement tie unit 3500A may contain one or more such sub interwoven networks placed one above the other in the similar pattern as described.

Now, referring to FIG. 22B, illustrated is a lateral reinforcement system 3500B (assembled form) comprising a plurality of elliptical reinforcement ties of FIG. 20 and FIG. 21 forming a three-dimensional interwoven network around a plurality of axially disposed structural bars 3600, 3700, 3800 and 3900. In the lateral reinforcement system 3500B, reinforcement ties 1800, 1900, 2000, 2100, 2700 and 2800 are disposed at an inclination to the axially disposed structural bars 3600, 3700, 3800 and 3900. That is, the reinforcement ties 1800, 1900, 2000, 2100, 2700 and 2800 are disposed at an angle to the axially disposed structural bars 3600, 3700, 3800 and 3900 making it also inclined at an angle to a surface on which the axially disposed structural bars 3600, 3700, 3800 and 3900 are disposed. The reinforcement ties 2700 and 2800 are similar to the reinforcement ties 1800 and 1900 as described above.

In this configuration, the reinforcement ties in a pair of reinforcement ties cross each other at diametrically opposite structural bars, such that, a first reinforcement tie of the pair of reinforcement ties crosses from inside of a second reinforcement tie of the pair of reinforcement ties at one structural bar, and the second reinforcement tie crosses from outside of the first reinforcement tie at the diametrically opposite structural bar.

For forming the lateral reinforcement system 3500B, a plurality of elliptical reinforcement tie units (such as the elliptical reinforcement tie units 1800, 1900, 2000, 2100, 2700 and 2800) are disposed on and the about the axially disposed structural bars 3600, 3700, 3800 and 3900. The process comprises placing a first elliptical reinforcement tie unit and then second elliptical reinforcement tie unit on top of the first reinforcement tie unit, such that the crossing of the ties present in the lower half part of the second elliptical reinforcement tie unit crosses the ties present in the upper half part of the first elliptical reinforcement tie unit at the periphery at one third of the diameter along the major axis and so on.

In this formation, the plurality of the elliptical reinforcement ties 1800, 1900, 2000, 2100, 2700 and 2800 form a three-dimensional interwoven network around the axially disposed structural bars 3600, 3700, 3800 and 3900. The three-dimensional interwoven network is a collection of sub-interwoven networks 3510, 3520 and 3530 formed by combining individual elliptical reinforcement tie units.

Also, the present invention provides a method for lateral reinforcement using the lateral reinforcement system of the present invention comprising the plurality of the reinforcement ties of the present invention.

Also, techniques, devices, subsystems and methods described and illustrated in the various embodiments as discrete or separate may be combined or integrated with other systems, modules, techniques, or methods without departing from the scope of the present technology.

It should be noted that reference throughout this specification to features, advantages, or similar language does not imply that all of the features and advantages should be or are in any single embodiment. Rather, language referring to the features and advantages may be understood to mean that a specific feature, advantage, or characteristic described in connection with an embodiment may be included in at least one embodiment of the present technology. Thus, discussions of the features and advantages, and similar language, throughout this specification may, but do not necessarily, refer to the same embodiment.

The invention claimed is:

1. A lateral reinforcement system for a concrete structure having axially disposed structural bars, the lateral reinforcement system comprising:

a plurality of reinforcement ties disposed at a non-orthogonal inclination to the axially disposed structural bars; wherein each of said plurality of reinforcement ties includes a dual hook member wherein a pair of reinforcement ties of the plurality of reinforcement ties cross each other at the dual hook member of the reinforcement ties, such that, a first reinforcement tie of the pair of reinforcement ties crosses from inside of a second reinforcement tie of the pair of reinforcement ties on one face, and the second reinforcement tie crosses from inside of the first reinforcement tie at an opposite face, and wherein the plurality of reinforcement ties form a three-dimensional interwoven network around the axially disposed structural bars.

2. The lateral reinforcement system of claim 1, wherein the dual hook member are capable of anchoring the reinforcement tie to the structural bars, and engaging a corner of another reinforcement tie.

3. The lateral reinforcement system of claim 2, wherein the first tie engages the second tie from the outside when crossing the second tie; and the second tie engages the first tie from the outside when crossing the first tie at the opposite corner.

4. The lateral reinforcement system of claim 1, wherein the ties are rhombical shaped reinforcement ties.

5. The lateral reinforcement system of claim 4, wherein the ties are mid-side kinked rhombical shaped reinforcement ties, each tie comprising a kink at the midpoint of each rhombical side of the rhombical shaped reinforcement tie.

6. The lateral reinforcement system of claim 5, wherein the pair of rhombical shaped reinforcement ties are placed at opposing inclination so that they cross each other at the kink of a corresponding rhombical side.

7. The lateral reinforcement system of claim 4, wherein the rhombical shaped reinforcement ties are one-third side kinked rhomboidal shaped, each tie comprising a kink at every one-third length of each rhombical side of a tie.

8. The lateral reinforcement system of claim 7, wherein the rhombical shaped reinforcement ties cross each other at the kink of a corresponding rhombical shaped reinforcement tie.

9. The lateral reinforcement system of claim 1, wherein the ties are elliptical shaped reinforcement ties.

* * * * *